US008424220B2

(12) United States Patent
Bae et al.

(10) Patent No.: US 8,424,220 B2
(45) Date of Patent: Apr. 23, 2013

(54) LAUNDRY DRYER AND METHOD FOR CONTROLLING THE SAME

(75) Inventors: Sang Hun Bae, Changwon-si (KR); Chang Woo Son, Busan (KR); Chul Jin Choi, Changwon-si (KR); Dong Hyun Kim, Changwon-si (KR); Young Bok Son, Changwon-si (KR); Heung Jae Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 511 days.

(21) Appl. No.: 12/304,309

(22) PCT Filed: Jun. 11, 2007

(86) PCT No.: PCT/KR2007/002813

§ 371 (c)(1),
(2), (4) Date: Dec. 11, 2008

(87) PCT Pub. No.: WO2007/145451

PCT Pub. Date: Dec. 21, 2007

(65) Prior Publication Data

US 2009/0265953 A1 Oct. 29, 2009

(30) Foreign Application Priority Data

Jun. 12, 2006 (KR) ..... 10-2006-0052681
Jan. 12, 2007 (KR) ..... 10-2007-0003716

(51) Int. Cl.

| | |
|---|---|
| ***F26B 3/00*** | (2006.01) |
| ***F26B 11/02*** | (2006.01) |
| ***F26B 3/34*** | (2006.01) |
| ***D06F 37/00*** | (2006.01) |

(52) U.S. Cl.
USPC ..... 34/467; 34/595; 34/260; 68/5 R

(58) Field of Classification Search ..... 34/467, 34/407, 595, 606, 260; 68/5 R; 38/77.5, 38/77.9, 85
See application file for complete search history.

(56) References Cited

U.S. PATENT DOCUMENTS

| | | | |
|---|---|---|---|
| 1,338,696 | A | 5/1920 | Power |
| 1,398,490 | A | 11/1921 | Arthur |
| 1,549,537 | A | 8/1925 | Henry |
| 1,567,709 | A | 12/1925 | Carroll |
| 1,601,431 | A | 9/1926 | Maurice |

(Continued)

FOREIGN PATENT DOCUMENTS

| | | |
|---|---|---|
| CN | 1580359 | 2/2005 |
| CN | 1609327 | 4/2005 |

(Continued)

OTHER PUBLICATIONS

U.S. Office Action issued in U.S. Appl. No. 11/796,435 dated Dec. 7, 2010.

(Continued)

*Primary Examiner* — Kenneth Rinehart
*Assistant Examiner* — John McCormack
(74) *Attorney, Agent, or Firm* — KED & Associates, LLP

(57) ABSTRACT

A dryer and a method for controlling the same are provided. The method for controlling a dryer includes supplying steam generated in a steam generator to a drum, and supplying hot air generated in a hot air heater to the drum. The method has an advantageous effect of removing wrinkles efficiently.

19 Claims, 16 Drawing Sheets

U.S. PATENT DOCUMENTS 1,786,191 A 12/1930 Carroll
1,909,384 A 5/1933 Kirk
1,965,480 A 7/1934 Nicola
1,998,912 A 4/1935 Max
RE19,986 E 5/1936 Silver
2,050,625 A 8/1936 Orr
2,114,776 A 4/1938 Ernest
2,506,476 A 5/1950 Max
2,523,305 A 9/1950 Johnson
2,595,663 A 5/1952 Howland
2,687,578 A 8/1954 Richterkessing
2,712,182 A 7/1955 Vetorino
2,758,461 A 8/1956 David
2,920,471 A 1/1960 Ramon
2,927,379 A 3/1960 Tann
2,929,674 A 3/1960 David
3,020,648 A 2/1962 Strike
3,032,887 A 5/1962 Whyte et al.
3,066,423 A 12/1962 Solem
3,121,000 A 2/1964 Hubbard
3,242,584 A 3/1966 Jacobs
3,256,617 A 6/1966 Goldberger
3,285,589 A 11/1966 Worst
3,402,576 A 9/1968 Krupsky
3,442,692 A * 5/1969 Gaiser ..... 427/240
3,601,292 A * 8/1971 Bliss ..... 68/6
3,619,919 A 11/1971 McMillan
3,627,008 A 12/1971 Samuelian
3,643,341 A 2/1972 Magin
3,651,580 A 3/1972 Meyer
3,808,846 A 5/1974 Fleissner
3,811,202 A 5/1974 Arendt
3,826,682 A 7/1974 Liebowitz et al.
3,866,333 A 2/1975 Sarukahanian et al.
4,003,136 A 1/1977 Vincent et al.
4,065,253 A 12/1977 Bullock
4,106,214 A 8/1978 Schmidt
4,137,645 A 2/1979 Bullock
4,167,594 A 9/1979 Schwadtke et al.
4,237,622 A 12/1980 Francis
4,267,643 A 5/1981 Haried
4,268,247 A 5/1981 Freze
4,285,219 A 8/1981 Grunewald
4,338,730 A 7/1982 Tatsumi et al.
4,414,765 A 11/1983 Kreinberg et al.
4,520,577 A 6/1985 Suissa
4,599,814 A 7/1986 Geiger
4,622,039 A 11/1986 Merenda
4,652,390 A 3/1987 Strampach et al.
4,735,738 A 4/1988 Willman
4,761,305 A 8/1988 Ochiai
4,781,041 A 11/1988 Fowler
4,797,128 A 1/1989 Fowler
4,797,656 A 1/1989 Keppler
4,800,655 A 1/1989 Mori et al.
4,936,920 A 6/1990 Keritsis et al.
5,042,524 A 8/1991 Lund
5,050,259 A 9/1991 Tsubaki et al.
5,050,313 A 9/1991 Wakaeya et al.
5,107,606 A 4/1992 Tsubaki et al.
5,212,969 A 5/1993 Tsubaki et al.
5,289,703 A 3/1994 Hiyashi et al.
5,343,632 A 9/1994 Dinh
5,367,787 A 11/1994 Ikeda et al.
5,376,144 A 12/1994 Mcclain et al.
5,431,205 A 7/1995 Gebhard
5,443,541 A 8/1995 St. Louis
2,726,664 A 12/1995 Webber
5,477,623 A 12/1995 Tomizawa et al.
5,546,678 A 8/1996 Dhaemers
5,557,704 A 9/1996 Dennis et al.
5,600,975 A 2/1997 Mcclain et al.
5,613,379 A 3/1997 Kim
5,621,370 A 4/1997 St. Louis
5,673,497 A 10/1997 St. Louis
5,704,230 A 1/1998 Mcclain et al.
5,709,201 A 1/1998 Puett
5,789,368 A 8/1998 You et al.
5,840,675 A 11/1998 Yeazell
5,863,299 A 1/1999 Holt et al.
5,872,090 A 2/1999 You et al.
5,891,197 A 4/1999 Young et al.
5,943,720 A 8/1999 Chung
5,979,435 A 11/1999 Puett
6,115,539 A 9/2000 Cohn
6,161,306 A 12/2000 Clodic
6,184,193 B1 2/2001 Yamada
6,233,771 B1 5/2001 Hortel et al.
6,243,969 B1 6/2001 Yeazell
6,262,009 B1 7/2001 Rogers et al.
6,324,771 B1 12/2001 McAllister et al.
6,434,857 B1 8/2002 Anderson et al.
6,510,280 B1 * 1/2003 Chen ..... 392/402
6,514,924 B1 2/2003 Van Hauwermeiren et al.
6,576,323 B2 6/2003 Wise et al.
6,585,781 B1 7/2003 Roseen
6,673,121 B2 1/2004 Mettlach et al.
6,684,440 B1 2/2004 Wise et al.
6,691,536 B2 2/2004 Severns et al.
6,745,496 B2 6/2004 Cassella
6,759,006 B1 7/2004 Siklosi et al.
6,796,055 B2 9/2004 Baltes
6,818,293 B1 11/2004 Keep et al.
6,833,032 B1 * 12/2004 Douglas et al. ..... 134/3
6,857,296 B2 2/2005 Fagg et al.
6,868,621 B1 3/2005 Grimm et al.
6,898,951 B2 5/2005 Severns et al.
6,904,703 B2 6/2005 Naganawa et al.
6,916,751 B1 7/2005 Kronzer
6,928,752 B2 8/2005 Johnson et al.
6,979,495 B2 12/2005 Keung et al.
7,020,983 B2 4/2006 Bolduan et al.
7,066,412 B2 6/2006 Conley et al.
7,073,356 B2 7/2006 Nakamura et al.
7,089,768 B2 8/2006 Bolduan et al.
7,162,812 B2 1/2007 Cimetta et al.
7,220,365 B2 5/2007 Qu et al.
7,275,400 B2 10/2007 Severns et al.
7,305,856 B2 12/2007 Bolduan et al.
7,325,330 B2 * 2/2008 Kim et al. ..... 34/407
7,356,945 B2 4/2008 Choi et al.
7,390,778 B1 6/2008 Strang et al.
7,418,789 B2 9/2008 Choi et al.
7,481,005 B2 1/2009 Bolduan et al.
7,520,145 B2 4/2009 Hong et al.
7,600,402 B2 10/2009 Shin et al.
7,607,246 B2 * 10/2009 Valiyambath Krishnan et al. ..... 38/77.83
7,621,155 B2 11/2009 Ahn
7,624,466 B2 12/2009 Kim et al.
7,647,663 B2 1/2010 Kim et al.
7,654,073 B2 2/2010 Primlani
7,665,227 B2 2/2010 Wright et al.
7,735,345 B2 6/2010 Wright et al.
7,814,770 B2 10/2010 Jeon et al.
7,882,716 B2 2/2011 Noro et al.
7,895,770 B2 3/2011 Bae et al.
7,905,120 B2 3/2011 Mamiya et al.
7,914,607 B2 3/2011 Moschutz et al.
7,921,578 B2 4/2011 Mcallister et al.
7,930,838 B2 4/2011 Bae et al.
7,934,279 B2 5/2011 Son
7,942,025 B1 5/2011 Musone
2001/0022007 A1 9/2001 Yeacell
2001/0055692 A1 12/2001 Heffelfinger
2002/0073491 A1 6/2002 Metlach et al.
2002/0133886 A1 9/2002 Severns et al.
2002/0133969 A1 9/2002 Cassella
2002/0155308 A1 10/2002 Heffelfinger et al.
2002/0184715 A1 12/2002 Taylor
2003/0000106 A1 1/2003 Anderson et al.
2003/0017958 A1 1/2003 Wise et al.
2003/0061841 A1 4/2003 Nakamura et al.
2003/0066638 A1 4/2003 Qu et al.
2003/0087781 A1 5/2003 Van Hauwermeiren et al.
2003/0224965 A1 12/2003 Conley et al.
2003/0233766 A1 12/2003 Bolduan et al.

2004/0000068 A1 1/2004 Bolduan et al.
2004/0000174 A1 1/2004 Bolduan et al.
2004/0000175 A1 1/2004 Bolduan et al.
2004/0010937 A1 1/2004 Naganawa et al.
2004/0038842 A1 2/2004 Fagg et al.
2004/0045187 A1 3/2004 Curry et al.
2004/0064966 A1 4/2004 Baltes
2004/0112095 A1 6/2004 Bolduan et al.
2004/0129032 A1 7/2004 Severns et al.
2004/0187529 A1* 9/2004 Kim et al. ..... 68/207
2004/0194339 A1 10/2004 Johnson et al.
2004/0214984 A1 10/2004 Keep et al.
2005/0000033 A1 1/2005 Park et al.
2005/0014673 A1 1/2005 Kwitkowski et al.
2005/0034248 A1 2/2005 Oh et al.
2005/0050644 A1 3/2005 Severns et al.
2005/0050756 A1 3/2005 Casella
2005/0081308 A1 4/2005 Kim et al.
2005/0092035 A1 5/2005 Shin et al.
2005/0115120 A1 6/2005 Cevik
2005/0172511 A1 8/2005 Cimetta et al.
2005/0189289 A1 9/2005 Hsiao
2005/0217035 A1 10/2005 Steiner et al.
2005/0223503 A1 10/2005 Hong et al.
2005/0223504 A1 10/2005 Lee et al.
2005/0262644 A1 12/2005 Oak et al.
2005/0278983 A1 12/2005 Rydberg
2006/0005581 A1 1/2006 Banba ..... 68/5
2006/0016020 A1 1/2006 Park
2006/0086001 A1 4/2006 Jeong et al.
2006/0090524 A1 5/2006 Jeon et al.
2006/0101588 A1 5/2006 Park et al.
2006/0112585 A1 6/2006 Choi et al.
2006/0117596 A1 6/2006 Kim et al.
2006/0130354 A1 6/2006 Choi et al.
2006/0137105 A1 6/2006 Hong et al.
2006/0137107 A1 6/2006 Lee et al.
2006/0150689 A1 7/2006 Kim et al.
2006/0151009 A1 7/2006 Kim et al.
2006/0194712 A1 8/2006 Conley et al.
2006/0201209 A1 9/2006 Lee et al.
2006/0254082 A1 11/2006 Kim
2006/0277690 A1 12/2006 Pyo et al.
2007/0062513 A1 3/2007 Gagas
2007/0101773 A1 5/2007 Park et al.
2007/0151041 A1 7/2007 Mcallister et al.
2007/0151129 A1 7/2007 Mcallister et al.
2007/0151310 A1 7/2007 Wright et al.
2007/0151311 A1 7/2007 Mcallister et al.
2007/0151312 A1 7/2007 Bruce et al.
2007/0163093 A1 7/2007 Wright et al.
2007/0163094 A1 7/2007 Wright et al.
2007/0163095 A1 7/2007 Mcallister et al.
2007/0163096 A1 7/2007 Mcallister et al.
2007/0163097 A1 7/2007 Metcalfe et al.
2007/0163098 A1 7/2007 Tomasi et al.
2007/0180728 A1 8/2007 Kim et al.
2007/0186593 A1 8/2007 Ahn
2007/0199352 A1 8/2007 Saal et al.
2007/0209228 A1* 9/2007 Meerpohl et al. ..... 34/595
2007/0227030 A1 10/2007 Oh et al.
2007/0261715 A1 11/2007 Lee et al.
2007/0266587 A1 11/2007 Bringewatt et al.
2008/0000098 A1 1/2008 Choi et al.
2008/0026131 A1 1/2008 Benjamin et al.
2008/0034808 A1 2/2008 Cho
2008/0052950 A1 3/2008 Park et al.
2008/0053162 A1 3/2008 Park et al.
2008/0053164 A1 3/2008 Park et al.
2008/0053166 A1 3/2008 Lim
2008/0099051 A1 5/2008 Kim et al.
2008/0099052 A1 5/2008 Lee et al.
2008/0115380 A1 5/2008 Nishino et al.
2008/0115381 A1 5/2008 Bae et al.
2008/0115540 A1 5/2008 Nishino et al.
2008/0141550 A1 6/2008 Bae et al.
2008/0141552 A1 6/2008 Bae et al.
2008/0141553 A1 6/2008 Son et al.
2008/0141554 A1 6/2008 Bae et al.
2008/0141557 A1 6/2008 Son et al.
2008/0141558 A1 6/2008 Bae et al.
2008/0141734 A1 6/2008 Son et al.
2008/0148494 A1 6/2008 Son et al.
2008/0148596 A1 6/2008 Son et al.
2008/0168679 A1 7/2008 Son et al.
2008/0196410 A1 8/2008 Primlani
2008/0209757 A1 9/2008 Park et al.
2008/0229936 A1* 9/2008 Kaneko et al. ..... 99/357
2008/0250822 A1 10/2008 Ahn
2008/0256720 A1 10/2008 Park et al.
2008/0256989 A1 10/2008 Jeong et al.
2008/0263783 A1 10/2008 Pyo
2008/0271263 A1 11/2008 Bae et al.
2008/0271500 A1 11/2008 Ahn
2008/0272934 A1 11/2008 Wang et al.
2008/0276381 A1 11/2008 Son
2008/0276659 A1 11/2008 Bae et al.
2008/0276660 A1 11/2008 Bae et al.
2008/0276661 A1 11/2008 Bae et al.
2008/0282751 A1 11/2008 Yoon et al.
2008/0289212 A1 11/2008 Moon et al.
2008/0302138 A1 12/2008 Bae et al.
2008/0313922 A1 12/2008 Bae et al.
2009/0025557 A1 1/2009 Moschutz et al.
2009/0038084 A1 2/2009 Lee et al.
2009/0049872 A1 2/2009 Noro et al.
2009/0049874 A1 2/2009 Mamiya et al.
2009/0064421 A1 3/2009 Lee et al.
2009/0064725 A1 3/2009 Lim et al.
2009/0071032 A1 3/2009 Kreutzfeldt et al.
2009/0077755 A1 3/2009 Park et al.
2009/0078007 A1 3/2009 Bae et al.
2009/0083988 A1 4/2009 Yoon et al.
2009/0083990 A1 4/2009 Bae et al.
2009/0095032 A1 4/2009 Lee
2009/0100882 A1 4/2009 Bae et al.
2009/0113745 A1 5/2009 Choi et al.
2009/0113755 A1 5/2009 Choi et al.
2009/0113944 A1 5/2009 Kim et al.
2009/0120140 A1 5/2009 Choi et al.
2009/0126222 A1 5/2009 Bae et al.
2009/0126421 A1 5/2009 Kim et al.
2009/0126423 A1 5/2009 Bae et al.
2009/0133281 A1 5/2009 Yoon et al.
2009/0133298 A1 5/2009 Kim et al.
2009/0139037 A1 6/2009 Jeong et al.
2009/0139277 A1 6/2009 Park et al.
2009/0159301 A1 6/2009 Chatot et al.
2009/0172967 A1 7/2009 Son et al.
2009/0183532 A1 7/2009 Kim et al.
2009/0193592 A1 8/2009 Stefanich et al.
2009/0199424 A1 8/2009 Bae et al.
2009/0201124 A1 8/2009 Kim et al.
2009/0211109 A1 8/2009 Choi et al.
2009/0235553 A1 9/2009 Bae et al.
2009/0235555 A1 9/2009 Jie Bo
2009/0241606 A1 10/2009 Yoo et al.
2009/0249639 A1 10/2009 Kim et al.
2009/0249839 A1 10/2009 Moon et al.
2009/0255146 A1* 10/2009 Klug et al. ..... 34/491
2009/0255299 A1 10/2009 Hiro et al.
2009/0260246 A1 10/2009 Bae et al.
2009/0260250 A1 10/2009 Moon et al.
2009/0265953 A1 10/2009 Bae et al.
2009/0277035 A1 11/2009 Choi et al.
2009/0277036 A1 11/2009 Lee et al.
2009/0277037 A1 11/2009 Lim
2009/0282695 A1 11/2009 Kreutzfeldt et al.
2009/0282696 A1 11/2009 Kim et al.
2009/0288456 A1 11/2009 Bae et al.
2009/0307921 A1 12/2009 Bae et al.
2009/0320213 A1 12/2009 Lee et al.
2009/0320313 A1 12/2009 Bae et al.
2009/0320314 A1 12/2009 Jo et al.
2009/0320318 A1 12/2009 Kim et al.
2009/0320530 A1 12/2009 Kim et al.
2010/0000117 A1 1/2010 Choi et al.
2010/0000269 A1 1/2010 Shin et al.

| | | | |
|---|---|---|---|
| 2010/0005598 | A1 | 1/2010 | Jung |
| 2010/0005681 | A1 | 1/2010 | Jo et al. |
| 2010/0018072 | A1 | 1/2010 | Kim et al. |
| 2010/0018262 | A1 | 1/2010 | Beihoff et al. |
| 2010/0024243 | A1 | 2/2010 | Ricklefs et al. |
| 2010/0043245 | A1 | 2/2010 | Noviello |
| 2010/0050464 | A1 | 3/2010 | Krzelowski et al. |
| 2010/0050465 | A1 | 3/2010 | Im et al. |
| 2010/0058608 | A1 | 3/2010 | Moon et al. |
| 2010/0058610 | A1 | 3/2010 | Kim et al. |
| 2010/0058814 | A1 | 3/2010 | Kim et al. |
| 2010/0058815 | A1 | 3/2010 | Lim et al. |
| 2010/0077628 | A1 | 4/2010 | Bae et al. |
| 2010/0077801 | A1 | 4/2010 | Son et al. |
| 2010/0083445 | A1 | 4/2010 | Kim et al. |
| 2010/0083711 | A1 | 4/2010 | Han et al. |
| 2010/0095716 | A1 | 4/2010 | Bae et al. |
| 2010/0101280 | A1 | 4/2010 | Im et al. |
| 2010/0107433 | A1 | 5/2010 | Paruzzolo et al. |
| 2010/0115784 | A1 | 5/2010 | Jo et al. |
| 2010/0115785 | A1 | 5/2010 | Ben-Shmuel et al. |
| 2010/0115788 | A1 | 5/2010 | Kim et al. |
| 2010/0115790 | A1 | 5/2010 | Arreghini |
| 2010/0139334 | A1 | 6/2010 | Kim et al. |
| 2010/0141013 | A1 | 6/2010 | Lahr |
| 2010/0147040 | A1 | 6/2010 | Kim et al. |
| 2010/0154250 | A1 | 6/2010 | Bae et al. |
| 2010/0180465 | A1 | 7/2010 | Noviello et al. |
| 2010/0186176 | A1 | 7/2010 | Wright et al. |
| 2010/0206016 | A1 | 8/2010 | Bae et al. |
| 2010/0229607 | A1 | 9/2010 | Persson et al. |
| 2010/0236001 | A1 | 9/2010 | Lee et al. |
| 2010/0257902 | A1 | 10/2010 | Persson et al. |
| 2010/0269266 | A1 | 10/2010 | Lee et al. |
| 2010/0281929 | A1 | 11/2010 | Han et al. |
| 2011/0005276 | A1 | 1/2011 | Moon et al. |
| 2011/0016743 | A1 | 1/2011 | Jung et al. |
| 2011/0016928 | A1 | 1/2011 | Beihoff et al. |
| 2011/0023321 | A1 | 2/2011 | Jung |
| 2011/0030147 | A1 | 2/2011 | Yoo et al. |
| 2011/0030427 | A1 | 2/2011 | Santarossa et al. |
| 2011/0030428 | A1 | 2/2011 | Han et al. |
| 2011/0032072 | A1 | 2/2011 | Han et al. |
| 2011/0041258 | A1 | 2/2011 | Ko et al. |
| 2011/0050441 | A1 | 3/2011 | Han et al. |
| 2011/0054843 | A1 | 3/2011 | Han et al. |
| 2011/0054844 | A1 | 3/2011 | Han et al. |
| 2011/0054845 | A1 | 3/2011 | Han et al. |
| 2011/0054967 | A1 | 3/2011 | Han et al. |
| 2011/0060553 | A1 | 3/2011 | Han et al. |
| 2011/0067457 | A1 | 3/2011 | Han et al. |
| 2011/0074589 | A1 | 3/2011 | Han et al. |
| 2011/0107617 | A1 | 5/2011 | Lee et al. |

FOREIGN PATENT DOCUMENTS

| | | | |
|---|---|---|---|
| CN | 1644787 | | 7/2005 |
| CN | 1696384 | | 11/2005 |
| DE | 1544345 | | 7/1969 |
| DE | 10332656 | | 7/2004 |
| DE | 103 02 866 | | 8/2004 |
| DE | 10 2007 007 354 | | 10/2007 |
| EP | 150728 | | 8/1985 |
| EP | 1 275 767 | | 1/2003 |
| EP | 1 544 345 | A2 | 6/2005 |
| EP | 1544345 | A2 * | 6/2005 |
| EP | 1 666 655 | A2 | 6/2006 |
| EP | 1 669 668 | | 6/2006 |
| EP | 1 900 865 | A1 | 3/2008 |
| EP | 1 932 963 | A1 | 6/2008 |
| EP | 1 936 021 | A2 | 6/2008 |
| EP | 1 939 349 | A2 | 7/2008 |
| EP | 2 014 820 | A1 | 1/2009 |
| JP | 01-175896 | A | 7/1989 |
| JP | 01-175897 | A | 7/1989 |
| JP | 01-265999 | A | 10/1989 |
| JP | 06-71093 | A | 3/1994 |
| JP | 06-233898 | | 8/1994 |
| JP | 07-000690 | A | 1/1995 |
| JP | 08-252395 | A | 10/1996 |
| JP | 09-173697 | A | 7/1997 |
| JP | 10-76251 | | 3/1998 |
| JP | 10-192595 | A | 7/1998 |
| JP | 11-276799 | | 10/1999 |
| JP | 2000-18782 | | 1/2000 |
| JP | 2005-48916 | | 2/2005 |
| JP | 2005-83708 | | 3/2005 |
| JP | 2005-130956 | | 5/2005 |
| JP | 2006-29649 | | 2/2006 |
| KR | 2004-0015957 | | 2/2004 |
| KR | 10-0640788 | | 10/2006 |
| WO | WO 2007/145432 | A1 | 12/2007 |
| WO | WO 2007/145448 | A2 | 12/2007 |
| WO | WO 2007/145451 | A2 | 12/2007 |
| WO | WO 2008/010671 | A2 | 1/2008 |
| WO | WO 2008/013426 | A2 | 1/2008 |
| WO | WO 2008/038959 | A2 | 4/2008 |
| WO | WO 2010/114332 | A2 | 10/2010 |

OTHER PUBLICATIONS

U.S. Office Action dated Jan. 26, 2011 (U.S. Appl. No. 11/980,736).
U.S. Office Action dated Mar. 30, 2010.
Chinese Office Action dated Sep. 25, 2009.
U.S. Office Action dated Sep. 29, 2009 (U.S. Appl. No. 11/706,435).
International PCT Search Report dated Dec. 12, 2007.
Notice of Allowance issued in U.S. Appl. No. 11/980,736 dated Jun. 2, 2011.
U.S. Office Action issued in U.S. Appl. No. 11/706,435 dated Jun. 22, 2011.
U.S. Office Action issued in U.S. Appl. No. 12/506,773 dated Jun. 19, 2012.
Final Office Action issued in U.S. Appl. No. 12/506,773 dated Sep. 21, 2012.
Office Action issued in U.S. Appl. No. 11/706,435 dated Oct. 4, 2012.

* cited by examiner

LAUNDRY DRYER AND METHOD FOR CONTROLLING THE SAME

TECHNICAL FIELD

The present invention relates to a dryer and a method for controlling the same. More specifically, the present invention relates to a dryer that can remove or prevent wrinkles on laundry, and a method for controlling the same.

BACKGROUND ART

Dryers are home appliances for drying washed laundry, i.e., a drying object, mostly like clothes, (hereinafter, the laundry) with hot air. In general, the dryer is provided with a drum in which the laundry is held, a driving source that drives the drum, heating means that heats the air introduced to the drum, and a blower unit that draws in or discharges air from the drum.

Based on methods of heating the air, i.e., the heating means, dryers may be classified into electric type dryers and gas type dryers. The electric type dryer heats the air with heat from electric resistance, and the gas type dryer heats the air with heat of burning gas. The dryers may be classified into condensation type (circulation type) dryers and exhaustion type dryers. In the condensing type dryer, air which becomes humid as a result of heat exchange with the clothes in the drum is not discharged to an outside of the dryer, but circulated in the dryer, and it is heat exchanged at a separate condenser to form condensed water which is discharged to an outside of the dryer. In the exhaustion type dryer, the air which becomes humid as a result of heat exchange with the clothes at the drum is discharged to an outside of the dryer directly. The dryers may be classified based on a method of loading the laundry into the dryer, into top loading type dryers and front loading type dryers. In the top loading type dryer, the laundry is introduced into the dryer from a top side, and in the front loading type dryer the laundry is introduced into the dryer from a front side.

The conventional dryer might have following problems.

Washed and dehydrated laundry is typically loaded to the dryer to be dried. However, as a matter of washing principle, it is inevitable that the laundry should be wrinkled during a washing cycle, and the wrinkles are not eliminated in a course of drying, perfectly. Consequently, in order to eliminate the wrinkles from the laundry, additional ironing has been required.

Moreover, the washed laundry may get wrinkles. Also, in case clothes are stored in cabinets and in case the clothes are worn, wrinkles, rumples, folds, and the like (called as wrinkles collectively) may be formed on the clothes. Accordingly, demands have been increasing for development of devices, which can easily remove the wrinkles caused by such common usage and storage of clothes is required.

DISCLOSURE OF INVENTION

Technical Problem

To solve the problems, an object of the present invention is to provide a dryer, and a method for controlling the same which can prevent and/or remove wrinkles from clothes, or the like.

Technical Solution

To achieve these objects and other advantages and in accordance with the purpose of the invention, as embodied and broadly described herein, a method for controlling a dryer includes a steam supply step for supplying steam generated in a steam generator to a drum; and a hot air supply step for supply hot air generated in a hot air heater to the drum.

The method may further include a drum heating step for heating an inside of the drum, prior to the steam supply step. In the drum heating step, the hot air generated in the hot air heater is supplied to the drum. Here, in the drum heating step, the hot air heater may be operated in a predetermined time period after the steam generator starts to operate. In the drum heating step, it is preferable that the hot air heater is operated when a water level inside the steam generator is high. In addition, in the drum heating step, the hot air heater may be operated at a predetermined capacity that is smaller than a rated power of the hot air heater.

In the drum heating step, the hot air heater may be stopped when steam starts to be generated in the steam generator. In the drum heating step, it is preferable that the operation of the hot air heater is forcibly stopped in a predetermined time period after the hot air heater starts to operate. The drum may be rotated in the drum heating step.

In the steam supply step, the drum may be rotated and it is preferable that the drum is rotated intermittently. At this time, the rotation time of the drum may be relatively longer than the stopping time of the drum.

On the other hand, the steam generator may start to heat water inside the steam generator when a water level of the steam generator is low. At this time, water supply to the steam generator may be stopped when the water level inside the steam generator is high. During the steam supply, water is supplied to the steam generator for a predetermined time period when the water inside the steam generator is low.

The method may further include a cooling step for cooling the drum. The method may further include a water drain step for draining water inside the steam generator after finishing the steam supply step. At this time, it is preferable that the water inside the steam generator is pumped to an outside in the water drain step.

On the other hand, the steam supply time in the steam supply step and the hot air supply time in the hot air supply step may be relatively adjustable. For example, the steam supply time and the hot air supply time for a laundry sterilization operation may be relatively longer than the steam supply time and the hot air supply time for a wrinkle removal operation. The steam supply time and the hot air supply time for a laundry fluffiness operation may be relatively shorter than the steam supply time and the hot air supply time for a wrinkle removal operation.

Advantageous Effects

Thus, the present invention enables effective prevention of formation of wrinkles on clothes and/or removal of wrinkles from clothes.

BEST MODE FOR CARRYING OUT THE INVENTION

Reference will now be made in detail to the specific embodiments of the present invention, examples of which are illustrated in the accompanying drawings.

In order to describe a dryer and a method for controlling the same of the present invention, a top loading type, electric type, and exhaust type dryer will be taken as an embodiment for the sake of convenience. However, the present invention is not limited to this, but the present invention is applicable to front loading type, gas type, and condensing type dryers, too.

Figure 1:
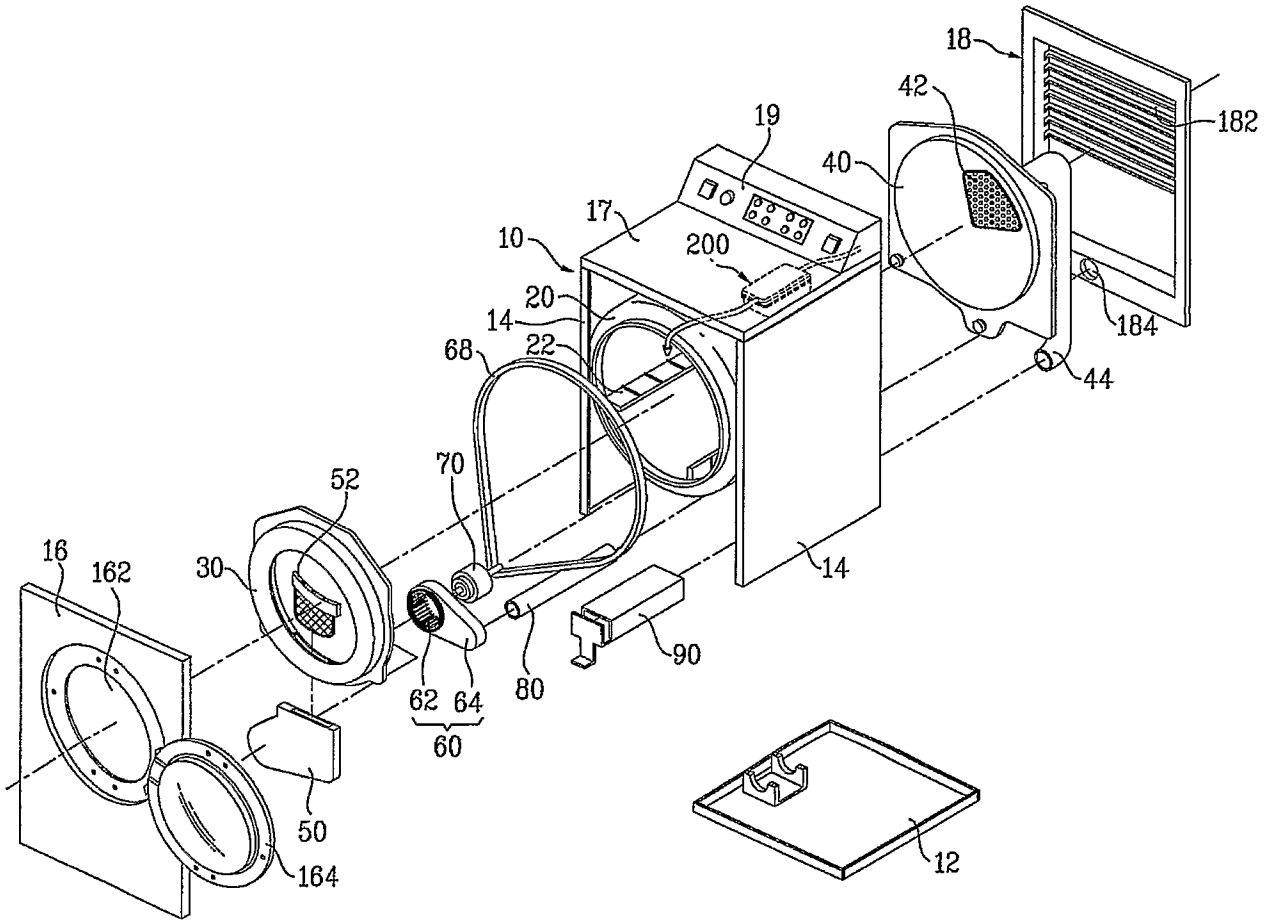
FIG. 1 illustrates an exploded perspective view of a dryer in accordance with a preferred embodiment of the present invention.
Figure 2:
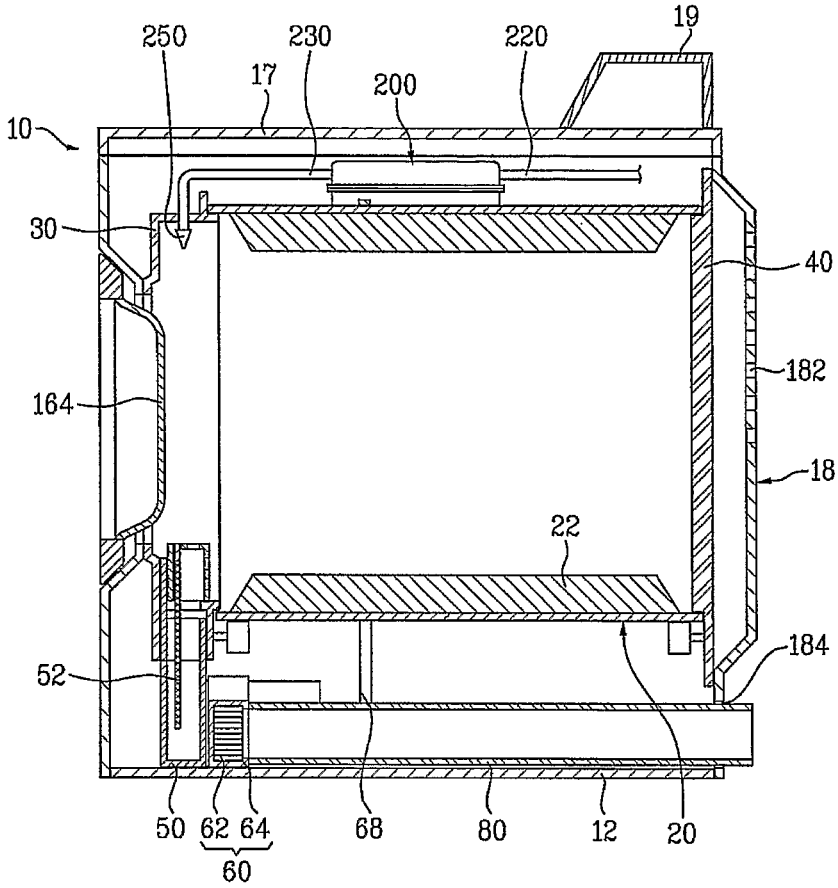
FIG. 2 illustrates a longitudinal section of the dryer in FIG. 1.

A dryer and a method for controlling the same in accordance with a preferred embodiment of the present invention will be described with reference to FIGS. 1 and 2.

Inside of a cabinet 10 which forms an exterior of the dryer, there are a rotatable drum 20, a motor 70 and a belt 68 for driving the drum 20. Mounted at a predetermined location of the cabinet 10, there are a heater 90 (will be called as hot air heater) for heating air to produce high temperature air (will be called as hot air), and a hot air supply duct 44 for supplying the hot air from the hot air heater 90 to the drum 20. And, an exhaust duct 80 for discharging humid air in the drum 20 and a blower unit 60 blowing the humid air are also mounted. In the meantime, mounted at a predetermined location of the cabinet 10, there is a steam generator 200 for generating hot steam. For convenience sake, in the embodiment, though the present invention is shown and described based on an indirect drive type in which the drum 20 is rotated by using the motor 70 and the belt 68, the present invention is not limited this, but the present invention is also applicable to a direct drive type in which the drum 20 is rotated directly by a motor directly connected to a rear of the drum 20.

Respective units of the dryer will be described in detail.

The cabinet 10 which forms an exterior of the dryer includes a base 12 which forms a bottom of the dryer, one pair of side covers 14 mounted to the base 12 vertically, a front cover 16 and a rear cover 18 mounted to a front and a rear of the side covers 14 respectively, and a top cover 17 located on top of the side covers 14. A control panel 19 with various operation switches is conventionally located on the top cover 17 or the front cover 16. The rear cover 18 has an inlet 182 for introduction of external air, and an exhaust hole 184 which is a final passage for discharging the air from the drum 20 to an outside of the dryer.

An inside space of the drum 20 serves as a drying chamber for drying the clothes, and, it is preferable that lifts 22 are provided in the drum 20 for lifting and dropping clothes, to turn the clothes upside down for enhancing drying efficiency.

In the meantime, mounted between the drum 20 and the cabinet 10, i.e., between the drum 20 and the front cover 16, there is a front supporter 30, and mounted between the drum 20 and the rear cover 18, there is a rear supporter 40. Rotatably mounted between the front supporter 30 and the rear supporter 40, there is the drum 20, and mounted between the front supporter 30 and the rear supporter 40 and the drum 20, there are sealing members (not shown) for preventing leakage. That is, the front supporter 30 and the rear supporter 40 cover the front and rear of the drum 20 to form the drying chamber, and support the front and rear of the drum 20, respectively.

The front supporter 30 has an opening to make the drum 20 to be in communication with an outside of the dryer, and the opening has a door 164 for selective opening/closing. The front supporter 30 also has a lint duct 50 connected thereto, which is a passage of the air from the drum 20 to an outside of the dryer, with a lint filter 52 mounted thereto. The blower unit 60 has one side connected to the lint duct 50, and the other side connected to the exhaust duct 80 which is connected to the exhaust hole 184 in the rear cover 18. Accordingly, if the blower unit 60 is operated, the air is discharged to an outside of the dryer from the drum 20 through the lint duct 50, the exhaust duct 80 and the exhaust hole 184. At this time, foreign matters, such as lint, are filtered at the lint filter 52. Commonly, the blower unit 60 includes a blower 62 and a blower housing 64. The blower 62 is connected to the motor 70 that drives the drum 20, and thus it is driven by the motor 70.

The rear supporter 40 has an opening portion 42 having a plurality of through holes and the hot air supply duct 44 is connected to the opening portion 42. The hot air supply duct 44 is in communication with the drum 20 to be employed as a passage for supplying the hot air to the drum 20. Accordingly, the hot air heater 90 is mounted to a predetermined location of the hot air supply duct 44.

Figure 3:
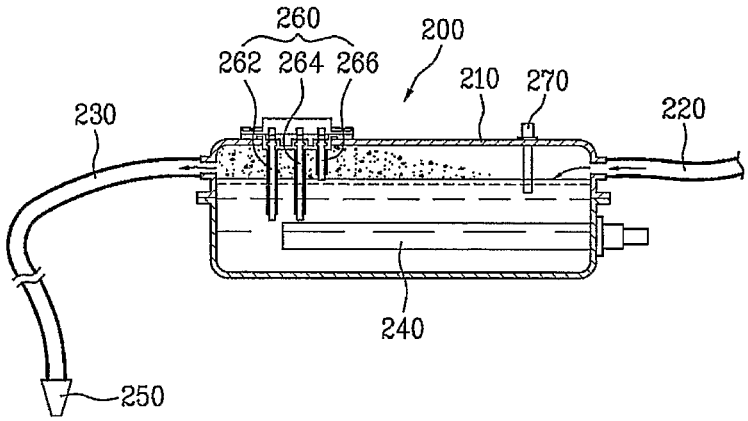
FIG. 3 illustrates a section of a steam generator in FIG. 1.

In the meantime, the steam generator 200 is mounted to a predetermined location of the cabinet 10 to generate steam and to supply the steam to the drum 20. The steam generator 200 will be described, with reference to FIG. 3.

The steam generator 200 includes a water tank 210 for holding water, a heater 240 mounted to an inside of the water tank 210, a water level sensor 260 for measuring a water level of the steam generator 200, and a temperature sensor 270 for measuring a temperature of the steam generator 200. The water level sensor 260 typically includes a common electrode 262, a low water level electrode 264, and a high water level electrode 266. Thus, the water level sensor 260 senses a high water level or a low water level based on electric connection between the common electrode 262 and the high water level electrode 264 or between the common electrode 262 and the low water level electrode 266.

A predetermined side of the steam generator 200 is connected to a water supply hose 220 through which water is supplied to the steam generator 200, and the other side of the steam generator 200 is connected to a steam hose 230 through which steam is supplied to the drum from the steam generator 200. It is preferable that a predetermined shape of nozzle 250 is provided to a front end of the steam hose 230. Commonly, one end of the water supply hose 220 is connected to an external water supply source, such as a tap. The front end or the nozzle 250 of the steam hose 230, which is a steam outlet, is provided at a predetermined location of the drum 20 to spray the steam to an inside of the drum 20.

In the meantime, this embodiment shows and describes a steam generator 200 (will be called as a tank heating type steam generator for convenience sake) in which a predetermined amount of water held in the water tank 210 having a predetermined size is heated by the heater 240 to generate the steam. However, the present invention is not limited to such steam generator. That is, the present invention can use any kinds of devices that can generate steam. For an example, a configuration may also be applicable that a heater is directly mounted around a water supply hose through which water passes to heat the water without a predetermined space in which the water is held (for convenience sake, will be called as tubular heating system).

Figure 4:
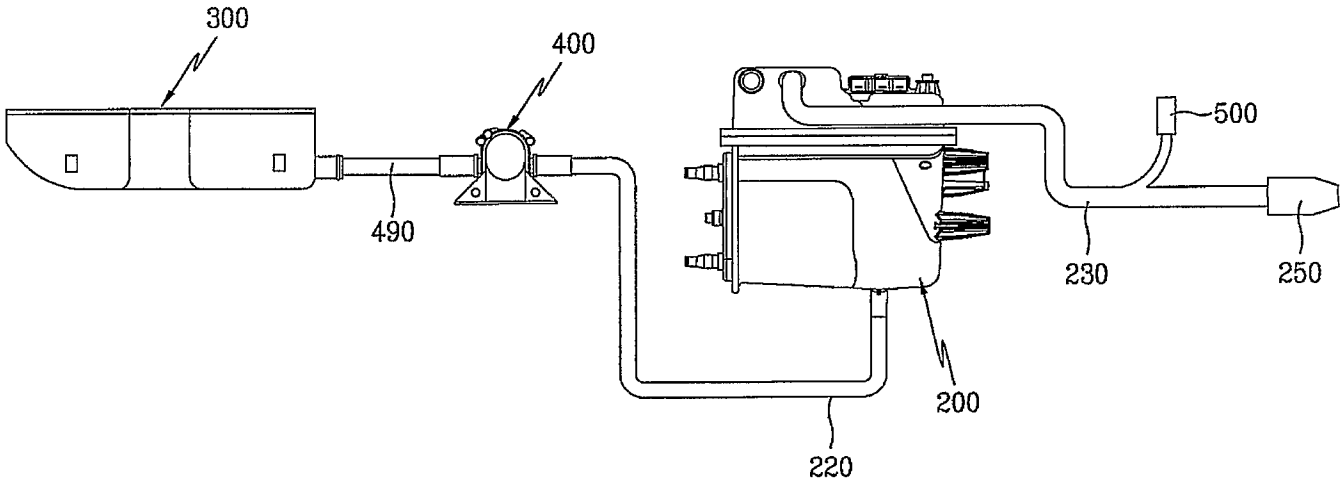
FIG. 4 illustrates a diagram of a dryer in accordance with a preferred embodiment of the present invention shown focused on a steam generator.

A dryer in accordance with another preferred embodiment of the present invention will be described, with reference to FIG. 4.

In this embodiment, a water supply source for supplying water to the steam generator 200 is separated from an external tap and it is preferable that the water supply source is detachable from the external tap. The water supply source may be a tap as mentioned in the above embodiment. However, in this case, it is complicated to install the water supply source, because water is not used in the dryers. As a result, if the tap is employed as the water supply source, it is necessary to install other various kinds of devices. Thus, it is convenient to use the separate water supply source, preferably the detachable water supply source 300 in accordance with this embodiment. If then, the water supply source 300 is detached to allow water supplied thereto and thus the water supply source 300 filled with water is connected to a water supply path of the steam generator, that is, a water supply hose 220.

A pump 400 may be mounted between the water supply source 300 and the steam generator 200 and the pump 400 is rotatable in a clockwise/counter-clockwise direction (hereinafter, regular/reverse direction). In this case, it is possible to supply the water to the steam generator 200 and it is also possible to drain water in the steam generator 200. If necessary, it is also possible that the water may be supplied to the steam generator 200 by using a water head between the water supply source 300 and the steam generator 200 without using the pump. However, because, in general, components of the dryer are standard goods of compact design, there are shortages of mounting spaces. Therefore, if sizes of the components of the related art dryer are not changed, the water supply by using the water head may be impossible. Accordingly, as use of a small sized pump 400 enables mounting of the steam generator 200 without changing the sizes of the components, use of the pump 400 is very good. The remained water in the steam generator 200 is drained from the steam generator 200 to prevent the heater from damage caused by the remaining and unused water for a long time and to prevent use of rotten water, later.

Though the foregoing embodiment shows water supply to, and steam discharge from an upper part of the steam generator 200, in the embodiment, it is preferable that the water is supplied to a lower part of the steam generator 200 and the steam is discharged from the upper part of the steam generator 200. This configuration is favorable for draining the remained water from the steam generator 200.

It is preferable that a safety valve 500 is provided to the steam flow passage, i.e., the steam hose 230, which discharges steam from the steam generator 200.

Each of the units will be described in detail.

Figure 5:
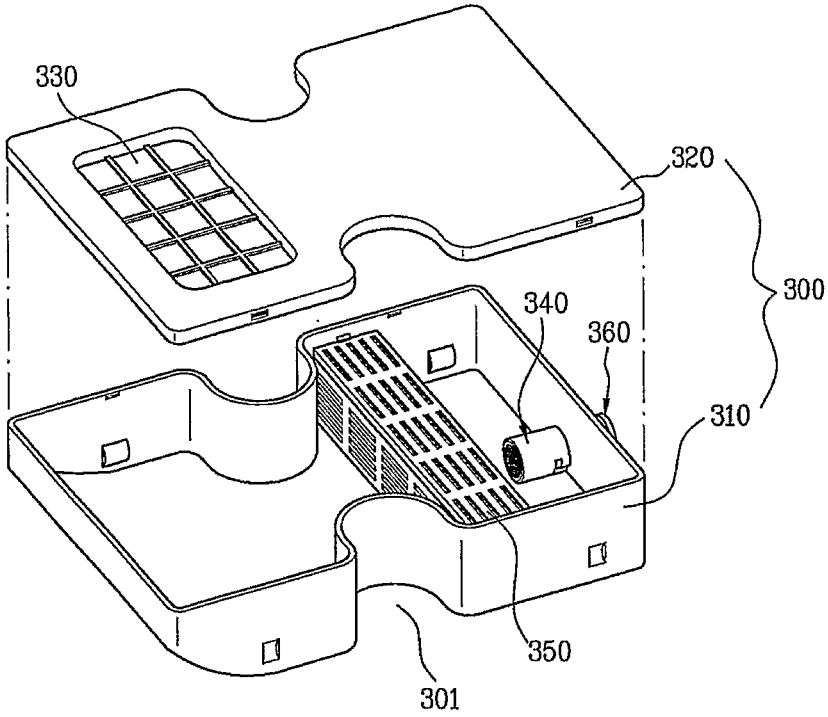
FIG. 5 illustrates an exploded perspective view of one example of the water supply source in FIG. 4.

The detachable water supply source 300 (for convenience sake, will be called as a cartridge) will be described with reference to FIG. 5.

The cartridge 300 includes a lower housing 310 for substantially holding water, and an upper housing 320 detachable from the lower housing 310. The cartridge 300 with the lower housing 310 and the upper housing 320 enables easy cleaning of scale on an inside of the cartridge 300, and easy disassembly of the filter 330 and 340 and the water softening member 350 for cleaning or regeneration.

It is preferable that the upper housing 320 has a first filter 330 mounted thereto. That is, it is preferable that the first filter 330 is mounted to a water inlet to the upper housing 320, for firstly filtering the water when the water is supplied to the cartridge 300.

It is preferable that the lower housing 310 has an opening/closing member 360 provided thereto for selective supply of the water to an outside of the cartridge 300, so that the water is not discharged to an outside of the cartridge 300 when the cartridge 300 is separated, and the water is discharged to the outside of the cartridge 300 when the cartridge 300 is mounted. It is preferable that the opening/closing member 360 has a second filter 340 connected thereto for filtering the water, and it is more preferable that the second filter is detachable. The first filter 330 and the second filter 340 enable double filtering of impurities, such as fine dust, from the water. It is preferable that the first filter 330 has about 50 mesh net, and the second filter 340 has a 60 mesh net. The 50 mesh net has 50 meshes per unit area. Accordingly, a size of a mesh hole of the first filter 330 is greater than a size of the mesh hole of the second filter 340, such that larger foreign matters are filtered at the first filter 330 primarily, and smaller foreign matters are filtered at the second filter 340.

Figure 6:
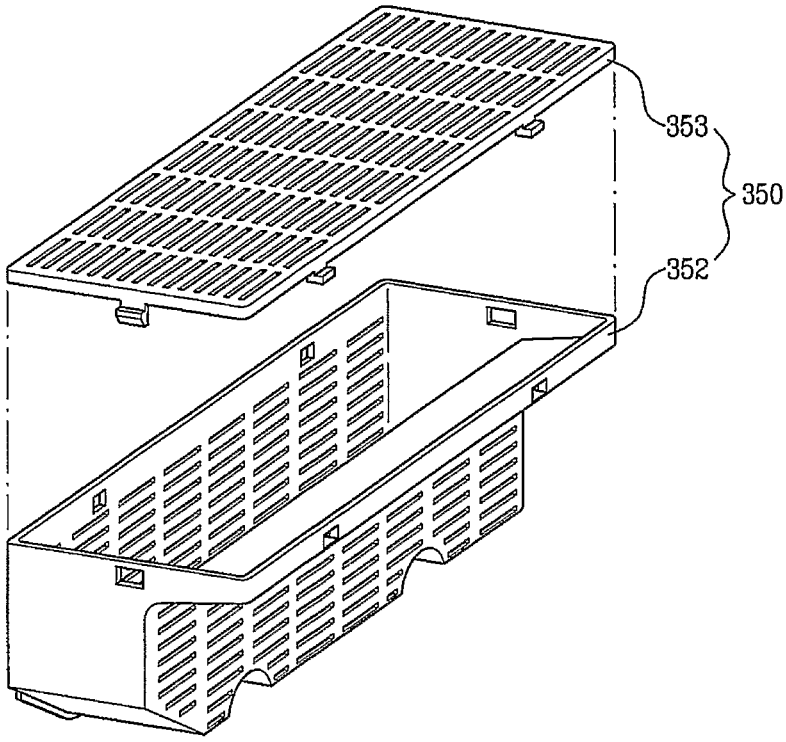
FIG. 6 illustrates an exploded perspective view of the water softening member in FIG. 4.

It is more preferable that the water softening member 350 is provided in the cartridge 300 for softening the water. It is more preferable that the water softening member 350 is detachable. As shown in FIG. 6, the water softening member 350 includes a lower housing 352 having a plurality of pass through holes, and a detachable upper housing 353 having a plurality of pass through holes, and preferably including ion exchange resin (not shown) filled in a space defined with the upper housing 353 and the lower housing 352.

The water softening member 350 is used under the following reason. When hardness of the water supplied to the steam generator 200 is high, if $Ca(HCO_3)_2$ dissolved in the water is heated, $CaCO_3$ deposits which is likely to corrode the heater. Particularly, the water in the Europe and the America has high hardness; such a phenomenon can be intensive. Therefore, it is preferable that calcium and magnesium are removed with the ion exchange resin, for preventing $CaCO_3$ from depositing. As performance of the ion exchange resin becomes poor as the ion exchange resin is used, the ion exchange resin may be regenerated with salt NaCl. For reference, a process for softening the water with the ion exchange resin is 2(R—SONa)+$Ca_2$(R—SO)Ca+2Na, and a process for regenerating the ion exchange resin is (R—SO)Ca+2NaCl2(R—SONa)+CaCl.

Figure 7:
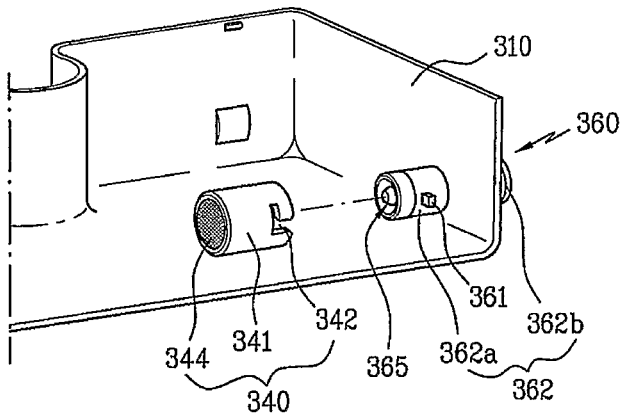
FIGS. 7 to 9 each illustrates a partially cut-away perspective view of the water softening member in FIG. 5.
Figure 8:
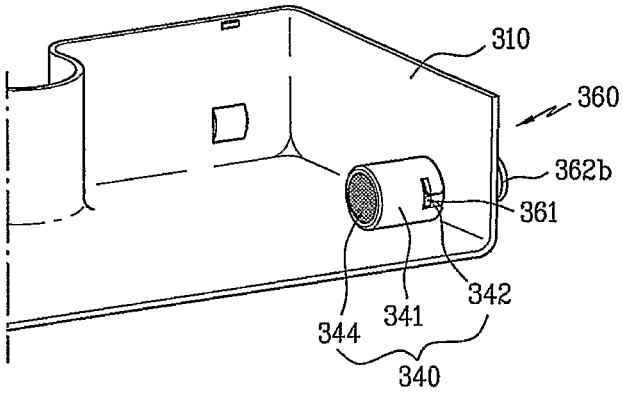
Figure 9:
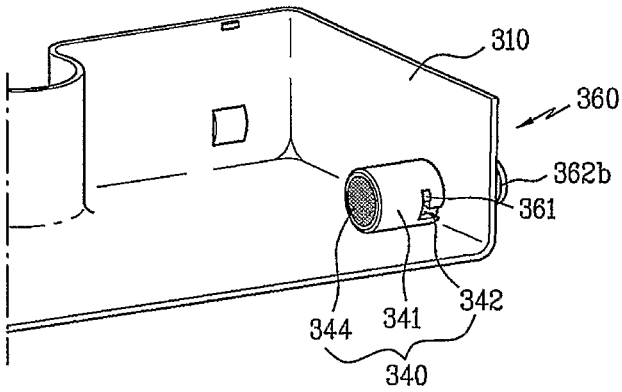

Structures for mounting/dismounting the second filter 340 and the opening/closing member 360 will be described in detail with reference to FIGS. 7 to 9.

Mounted to the lower housing 310 of the cartridge 300, there is the opening/closing member 360 in communication with the cartridge 300. The opening/closing member 360 includes a flow passage 362 in communication with the cartridge 300, and a pin 365 for selective opening/closing of the flow passage 362. The flow passage 362 has an inner flow passage 362*a* and an outer flow passage 362*b*, and the inner flow passage 362*a* has a stopper 361 on an outside surface. The second filter 340 includes a case 341 with a shape in conformity with the inner flow passage 362*a*, and a filtering portion 344 at one side of the case 341. The case 341 has a slot 342 with a shape in conformity with the stopper 361. The slot 342 has an L shape substantially, i.e., a horizontal portion and a vertical portion. Therefore, after pushing the slot 342 of the second filter 340, more specifically, the horizontal portion, in a direction of the stopper 361 as shown in FIG. 8, if the second filter 340 is turned as shown in FIG. 9, coupling of the second filter 340 and the opening/closing member 360 is completed. Since dismounting of the second filter 340 from the opening/closing member is reverse of above, detailed description of which will be omitted.

Connection between the cartridge 300 and the pump 400 will be described in detail, with reference to FIG. 10.

Figure 10:
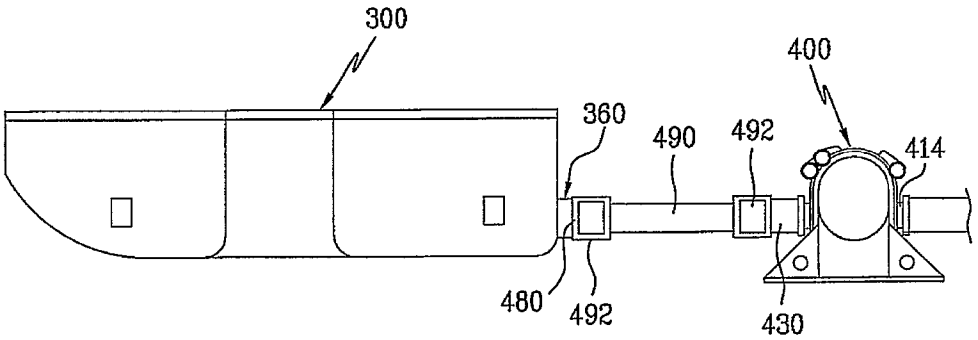
FIG. 10 illustrates a side view of a connection between the water supply source and the pump in FIG. 4.

Referring to FIG. 10, the cartridge 300 and the pump 400 are connected with an intermediate hose 490. The intermediate hose 490 has one side connected to the inlet 430 of the pump 400 and the other side connected to the cartridge with a connector 480. It is preferable that the inlet 430/the connector 480 of the pump 400 and the intermediate hose 490 are made to prevent leakage with clamps 492.

Connection between the cartridge 300 and the connector 480 will be described in detail with reference to FIGS. 11 and 13.

As described before, the cartridge 300 has the opening/closing member 360 in communication with the cartridge 300. The opening/closing member 360 includes the flow passage 362, and the pin 365 for selective opening/closing of the flow passage 362. The flow passage 362 has the inner flow passage 362*a* and the outer flow passage 362*b*, and the outer flow passage 362*b* has an O-ring 369 for sealing.

Figure 13:
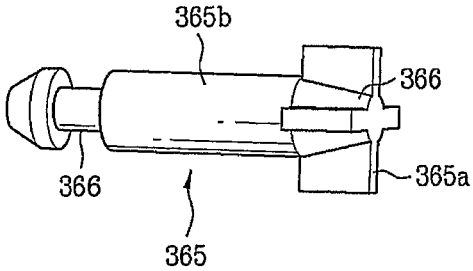
FIG. 13 illustrates a perspective view of a variation of the pin in FIG. 11.

In the meantime, the pin 365 has a recessed portion 366 in one side of a body 365*b*, and a flowing portion 365*a* on the other side (See FIG. 13). An opening/closing portion 367 is mounted to the recessed portion 366, and the flowing portion 365*a* in a cross shape substantially for flow of water between the cross. It is preferable that the opening/closing portion 367 is formed of rubber.

The flow passage 362 will be described. Provided to an inside of the flow passage, there is a supporting portion having a plurality of pass through holes 363*a* formed therein for supporting the body 365*b*, and provided between the supporting portion 363*b* and the flowing portion 365*a* of the pin 365, there is a spring 364. The connector 480 has an outer portion 482 having an inside diameter greater than an outside diameter of the outer flow passage 362*b* of the opening/closing member 360, and an inner portion 484 having an outside diameter smaller than an inside diameter of the outer flow passage 362*b*.

Figure 11:
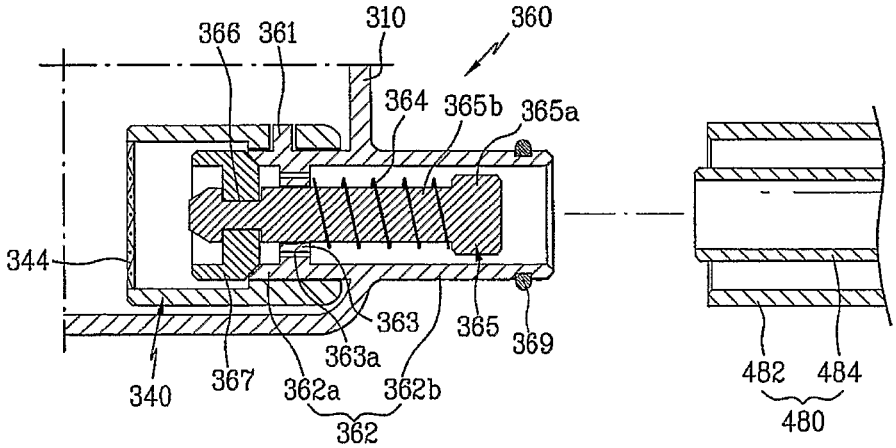
FIGS. 11 and 12 illustrate sections showing connection/disconnection of the water supply source in succession.
Figure 12:
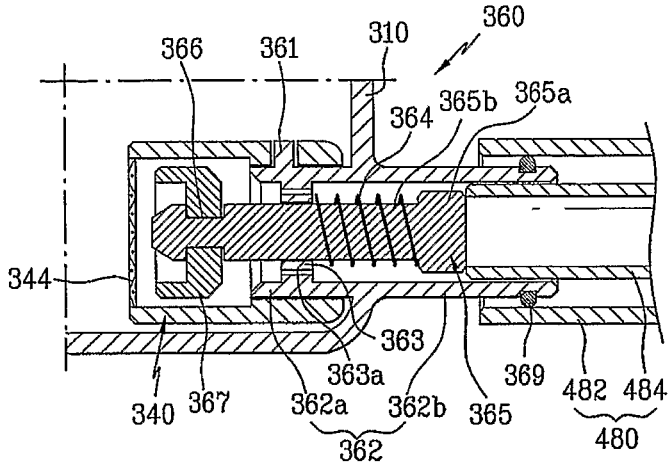

Referring to FIG. 11, in a state the cartridge 300 is separated from the connector 480, the opening/closing member 367 on one side of the pin 365 closes a fore end of the inner flow passage 362*a* by the spring 364. Accordingly, no water flows to an outside from the cartridge 300 through the flow passage. However, as shown in FIG. 12, if the cartridge 300 is connected in the connector 480, the inner portion 484 of the connector 480 pushes the pin 365 forward in a direction of the inner flow passage 362*a* against elastic force of the spring 364. Accordingly, the opening/closing member 367 on one side of the pin 365 is moved away from the fore end of the inner flow passage 362*a*, permitting water to flow through a gap between the opening/closing member 367 and the fore end of the inner flow passage 362*a*, such that the water flows from the cartridge 300 toward an outside, i.e., toward the pump 400 through the flow passage. In the present invention, the double sealing with the O-ring 369 and the spring 364 enables effective prevention of leakage of the water.

Referring to FIG. 13, it is preferable that one end of the pin 365, i.e., an inside 366 of the flowing portion 365*a* is tapered, for providing a larger passage area of water flow compared to a simple cylindrical shape, for more effective flow of the water.

Figure 14:
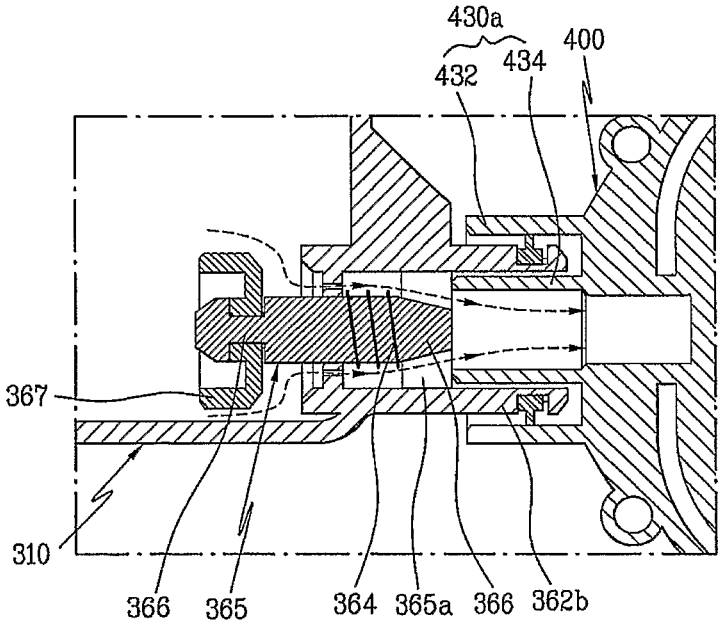
FIG. 14 illustrates a section of another embodiment of the connection between the water supply source and the pump in FIG. 4.

In the meantime, referring to FIG. 14, the cartridge 300 may be connected to the pump 400 directly without the intermediate hose 490. In this instance, it is required that a shape of an inlet 430*a* of the pump 400 is changed appropriately, i.e., an outer portion 432 and an inner portion 434 are formed. That is, a shape of the inlet 430*a* of the pump 400 is formed similar to the connector 480 in FIG. 11. Since the above inlet shape permits to dispense with the intermediate hose 490 and the clamps 492 for sealing in comparison to the connection in FIGS. 10 and 11, material cost and man-hour can be saved.

In the meantime, the foregoing embodiment shows and describes a cartridge 300 with detachable first filter 330, second filter 340, and water softening member 350, the present invention is not limited to this. For an example, the present invention is applicable to a case when an external tap is used as the water supply source 300. in this case, it is preferable that at least one of the first filter 330, the second filter 340, and the water softening member 350 is mounted to the water supply flow passage connected to the steam generator 200, and more preferably, detachable ones in this case too. It is preferable that the first filter 330, the second filter 340, and the water softening member 350 are integrated into one container which is also detachable from the water supply flow passage.

Figure 15:
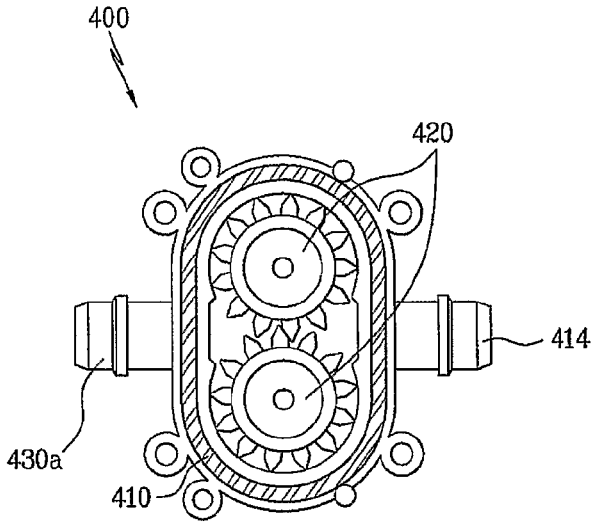
FIG. 15 illustrates a section of an example of the pump in FIG. 4, schematically.

The pump 400 will be described with reference to FIG. 15.

The pump 400 supplies water to the steam generator selectively. It is preferable that the pump 400 is reversible for selective supplying or draining of the water to/from the steam generator 200.

The pump 400 may be a gear type, pulsating type, diaphragm type, or so on. By changing a polarity of a circuit, the pulsating type, or diaphragm type pump can control a fluid flow direction in regular/reverse directions. As an example of an applicable pump 400, a gear type pump 420 is shown in FIG. 15. The gear type pump 400 has one pair of gears 420 in a case 410 having an inlet 430, 430*a*, and an outlet 414. That is, depending on a rotation direction of the gears 420, the water can be pumped in a direction from the inlet 430, 430*a* to the outlet 414, or from the outlet 414 to the inlet 430, 430*a*.

The nozzle 250 will be described in detail with reference to FIGS. 16 to 20.

Figure 16:
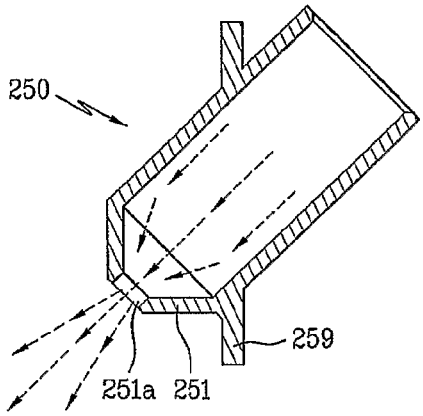
FIG. 16 illustrates a section of an example of the nozzle in FIG. 4.

Referring to FIG. 16, the nozzle 250 may have a general shape. That is, the nozzle 250 is formed in a shape of an enlarged-reduced tube, for spraying steam to the drum through a spray hole 251*a* formed in a fore end of the nozzle 250. It is preferable that the nozzle 250 has a supporting portion 259 for mounting the nozzle 250. As shown in FIG. 16, if the steam is simply sprayed through the spray hole 251*a* at the fore end of the nozzle 250, the wrinkle removal performance of the steam can be poor because the steam is sprayed to a limited portion of the drum by a kinetic energy of the steam. Therefore, it is preferable that the shape of the nozzle 250 is changed, appropriately.

Figure 17:
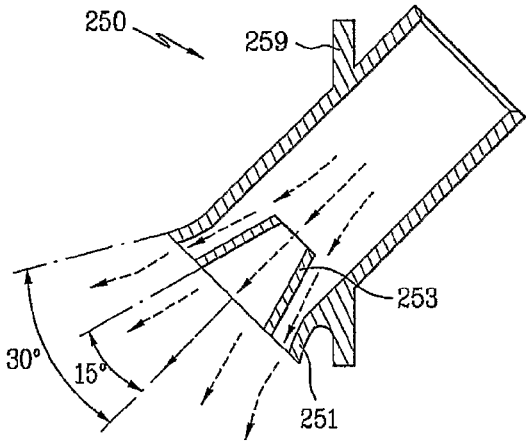
FIGS. 17 and 18 illustrate a section and a perspective view of other examples of the nozzle in FIG. 4, respectively.

Another embodiment of the nozzle 250 will be described with reference to FIGS. 17 and 18.

It is preferable that a supplementary nozzle 253 is provided inside the nozzle 250 connected to the steam generator 200 to supply steam to the drum. In this case, it is preferable that the nozzle 250 has a shape of which diameter is not varied or that the nozzle 250 is a reduced-enlarged tube. If the nozzle 250 is the reduced-enlarged tube, it is preferable that the nozzle 250 has a diameter which becomes slightly greater at the fore end 251. It is preferable that the supplementary nozzle 253 has the reduced-enlarge shape, and a cone shape. It is preferable that an outward slope angle of the supplementary nozzle 253 is smaller than an outward slope angle of the nozzle 250. For an example, the nozzle 250 is sloped at 30 degrees outwardly, and the supplementary nozzle 253 is sloped at 15 degrees outwardly.

The foregoing configuration makes a diffusion angle of the steam greater, enabling uniform wetting of the clothes with the steam, to improve the wrinkle removal performance.

In the meantime, it is preferable that a connection portion 255 is provided for connecting the nozzle 250 to the supplementary nozzle 253. This configuration enables unitization of the nozzle 250, the supplementary nozzle 253, and the connection portion 255, which improves formation of a mold, and mass productivity.

Figure 18:
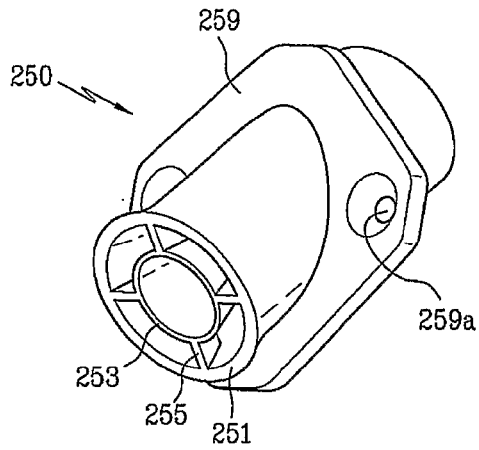

In FIG. 18, unexplained reference numeral 259*a* denotes a fastening hole in the supporting portion.

Figure 19:
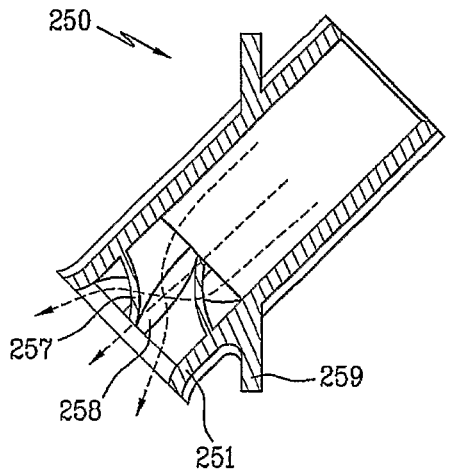
FIGS. 19 and 20 illustrate a section and a perspective view of other examples of the nozzle in FIG. 4, respectively.
Figure 20:
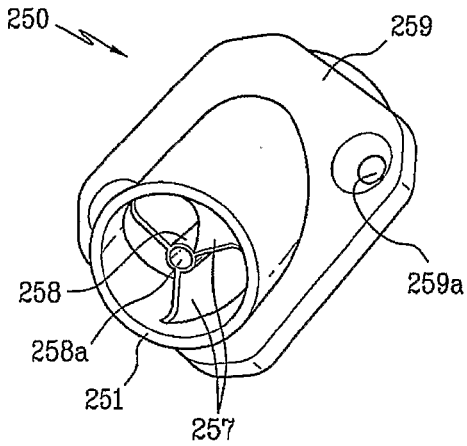

Another embodiment of the nozzle 250 will be described with reference to FIGS. 19 and 20.

It is preferable that a vortex generating member is provided in the nozzle 250 for generating a vortex. In this case, it is preferable that the nozzle 250 has a shape of which diameter is constant, or a reduced-enlarged tube shape. If the nozzle 250 has the reduced-enlarged tube shape, it is preferable that the nozzle 250 has a fore end 251 with a slightly greater diameter.

It is preferable that the vortex generating member is a blade 257. Preferably, the blade 257 is an extension from an inside wall of the nozzle 250, with a curve. In this instance, though a plurality of blades 257 may be connected at a center of the nozzle 250 directly, it is more preferable that the nozzle 250 has a center member 258 in the nozzle 250, and the blades 257 are connected between the inside wall of the nozzle 250 and the center member 258. It is more preferable that the center member 258 has a flow passage 258*a* formed therein. This configuration can improve forming of a mold, and mass productivity.

Above configuration forms vortex of the steam to increase a kinetic energy and a diffusion angle, enabling the steam to wet the clothes uniformly, and improving a wrinkle removal performance.

Figure 21:
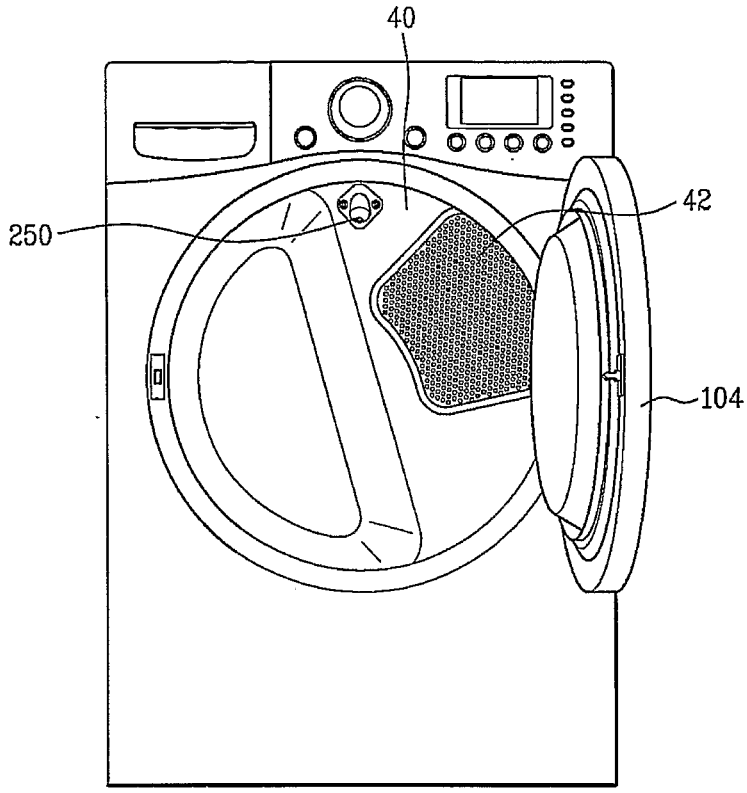
FIG. 21 illustrates a front view of an example of mounting of the nozzle in FIG. 4.

In the meantime, referring to FIG. 21, it is preferable that the nozzle 250 is mounted adjacent to the opening portion 42 for spraying the steam from a rear to a front of the drum. Because in general the air is introduced into the drum through the opening portion 42 in the rear supporter 40 and escapes through the lint duct (not shown, see FIG. 1) under the door 104, an air flows from the opening portion 42 to the lint duct. Thus, if the nozzle 250 is mounted adjacent to the opening portion 42, the sprayed steam flows following the air flow smoothly, enabling the steam to wet the clothes, uniformly.

In the meantime, the nozzle 250 described in the embodiment is applicable to ones other than the dryer having a detachable water supply source 300. For an example, the nozzle 250 described in the embodiment is applicable to a case when an external tap is used as the water supply source 300.

The safety valve 500 will be described with reference to FIGS. 22 and 23.

In a case the steam generator is operative normally, the steam is sprayed to the drum through the steam hose 230, and the nozzle 250. However, if fine fabric particles, such as lint or foreign matters formed in a clothes drying process, attach to and accumulate on the spray hole 251*a* of the nozzle 250 to block the spray hole 251*a*, the steam can not be discharged to the drum normally, but, oppositely, acts as a pressure to increase a pressure of the steam generator 200 itself, to damage the steam generator. Particularly, in a steam generator of tank heating type, in general since the water tank is not designed as a high pressure vessel which can withstand a high pressure, such a hazard is likely. Accordingly, it is preferable that an appropriate safety device is provided.

The safety valve 500 serves to discharge the steam to an outside of the steam generator if the steam flow passage is blocked. Therefore, it is preferable that the safety valve 500 is provided to the steam flow passage, for an example, the steam hose 230, and more preferably, in the vicinity of the fore end of the steam hose 230, for an example, adjacent to the nozzle 250.

The safety valve 500 includes a case 510 having one side in communication with the steam hose 230, and the other side in communication with an outside of the steam generator, and an opening/closing portion 530 for selective opening/closing of the case 510 and the steam hose 230. The opening/closing portion 530 is mounted to a steam flow passage communication portion 513 of the case 510, and the opening/closing portion 530 is supported by a spring 520. Of course, the spring 520 has one side supported on the opening/closing portion 530, and the other side supported on a fixed portion 540 fixed to the case 510 in a predetermined method.

Figure 22:
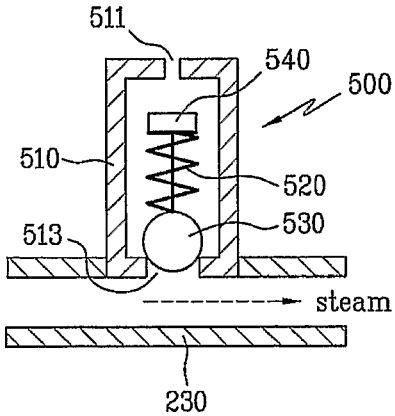
FIGS. 22 and 23 illustrate sections respectively showing an example of the safety valve in FIG. 4, schematically.
Figure 23:
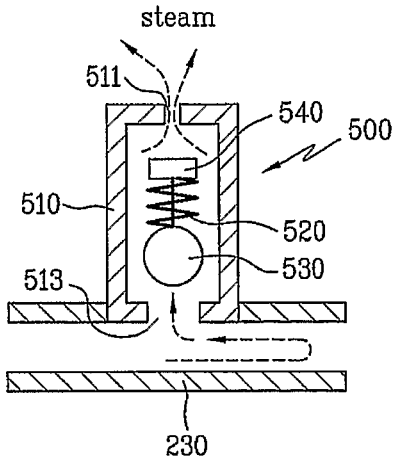

Referring to FIG. 22, if a pressure of the steam hose 230 is below a predetermined pressure as the steam hose 230 is not blocked, the steam can not overcome elastic force of the spring 520. Therefore, the opening/closing portion 530 blocks the steam flow passage communication portion 513, resulting in no steam discharge to the outside of the steam generator. However, as shown in FIG. 23, if the steam hose 230 is blocked, to cause the pressure of the steam hose 520 higher than a predetermined pressure, for an example, 1 kgf/$cm^2$, the steam pressure overcomes the elastic force of the spring 520. According to this, the opening/closing portion 530 that blocks the steam flow passage communication portion 513 moves, allowing the steam to be discharged to the outside of the steam generator through the steam flow passage communication portion 513 and an outside communication portion 511.

Figure 24:
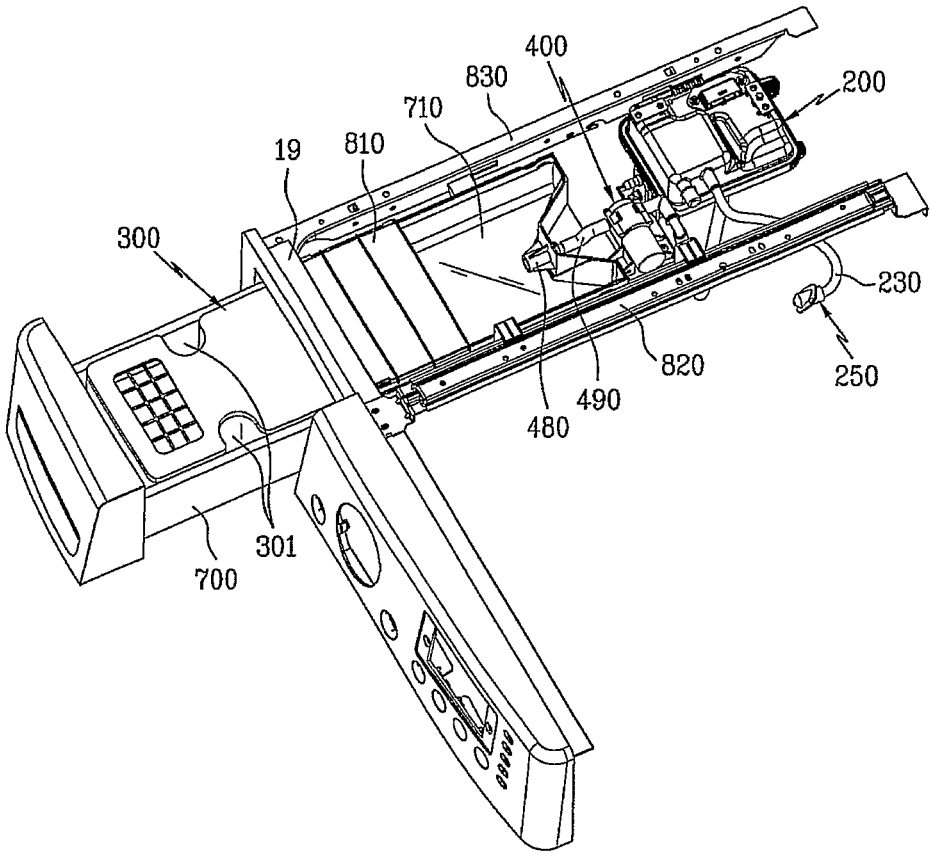
FIG. 24 illustrates a perspective view showing an example of mounting of the unit in FIG. 4.

Mounting of components of a steam line, mainly the steam generator, in accordance with a preferred embodiment of the present invention will be described with reference to FIG. 24.

It is preferable that a drawer type container 700 (will be called as a drawer) which can be pushed in/pulled out at a predetermined location of the dryer is provided. It is also preferable that the cartridge 300 is placed in the drawer 700. That is, rather than connecting the cartridge 300 to the connector 480 directly, it is preferable that the cartridge 300 is placed in the drawer 700, and the drawer is pushed in/pulled out so that the cartridge 300 is connected/disconnected to/from the connector 480.

It is preferable that the drawer 700 is provided to the front of the dryer, for an example, to the control panel 19. In detail, a supporter 820 is provided on a rear side of the control panel 19. That is, it is preferable that the supporter 820 is mounted parallel to the top frame 830 substantially, and a drawer guide 710 is mounted to the supporter 820 and the top frame 830 for guiding and supporting the drawer 700, and it is more preferable that a top guide 810 is provided to a portion of an upper portion of the drawer guide 710.

More preferably, the drawer guide 710 has opened upper portion and one side (on a front side of the dryer), so that the drawer 700 is pushed in/pulled out through the opened one side, and the connector 480 is provided to an upper portion of the other side of the drawer guide 710.

As described before, it is preferable that the drawer 700 is mounted to the front of the dryer in view of convenience of use of the dryer. As FIG. 24 illustrates a dryer in which the control panel 19 is mounted to a front cover, the drawer 700 being pushed in/pulled out of the control panel 19 has been described. However, the present invention is not limited to this, for an example, if the control panel is mounted to a top cover as shown in FIG. 1, the drawer 700 may be mounted to the front cover, directly.

In the meantime, the cartridge 300 is placed in the drawer 700 and it is preferable that at least shapes of opposite sides of the cartridge 300 are in conformity with shapes of opposite sides of the drawer 700, so that the cartridge 300 is fastened to the drawer 700, closely. It is preferable that recesses 301 are formed in opposite sides of the cartridge 300 for mounting/dismounting of the cartridge 300.

A method for supplying water to the cartridge 300 will be described with reference to FIG. 24.

When the user pulls out the drawer 700, the cartridge 300 is also pulled out. In this state, the cartridge 300 is dismounted from the drawer 700. Water is supplied to the dismounted cartridge 300 through a water supply hole, for an example, the first filter 330, to fill the cartridge 300 with water. The cartridge 300 having the water filled therein is mounted to the drawer 700 again, and then, if the drawer 700 is pushed in, the cartridge 300 and the connector 480 are connected automatically, opening the water in the cartridge 300 to the pump 400.

After finishing the operation of the dryer, the cartridge 300 can be dismounted from the drawer 700 in steps opposite to above description. Since the cartridge 300 of the present invention has the upper housing 320 and the lower housing 310, cleaning of dismounted cartridge 300 is easy.

Figure 25:
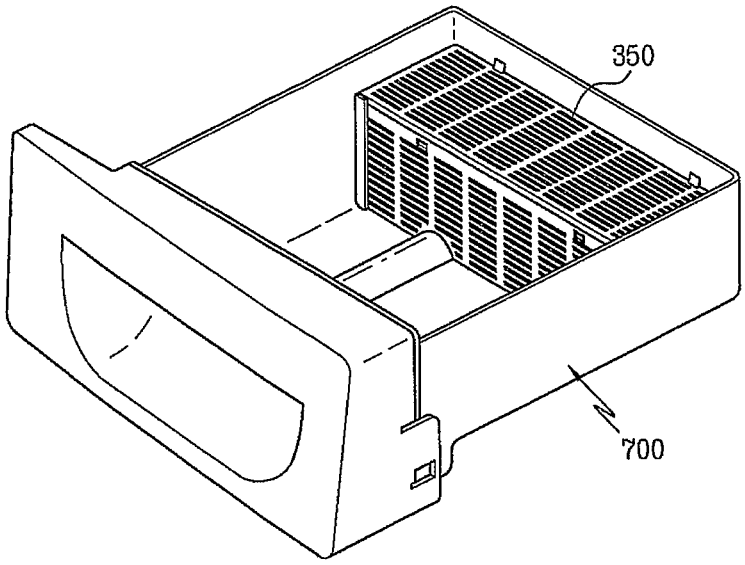
FIG. 25 illustrates a perspective view of other example of the water supply source in FIG. 4.

In the meantime, referring to FIG. 25, it is also possible that the drawer 700 is directly used as a water supply source. However, in a case the drawer 700 is directly used as the water supply source, the water can overflow from the drawer 700 at the time of water supply due to negligence of the user, if the cartridge 300 is used as the detachable water supply source as described before, such a problem can be prevented to a certain extent. The case when the drawer 700 is used as a direct water supply source is advantageous in that a structure of the steam generator can be made simple. Though FIG. 21 illustrates that only the water softening member 350 is placed in the drawer 700 for convenience sake, the first filter 330 and the second filter 340 may also be placed therein.

A method for controlling a dryer in accordance with a preferred embodiment of the present invention will be described with reference to FIGS. 26 and 27.

There may be two kinds of methods for operating the dryer in the present invention. That is, a drying operation, i.e., an operation for drying clothes, which is an original function of a general dryer and an operation of the present invention, i.e., an operation which can remove wrinkles from the clothes (for convenience sake, will be called as a refresh operation). By the refresh operation, not only the removal of the wrinkle, but also functions, such as sterilizing, deodoring, prevention of static electricity, fluffiness of the clothes, and so on, can be made. Because the method for controlling a dryer for the drying operation includes a hot air supplying step and a cooling step, and has been used in the related art, detailed description of which will be omitted. The method for controlling a dryer for the refresh operation includes a steam supply step especially, which will be described in detail.

The method for controlling a dryer for the refresh operation includes a steam supplying step (SS5) for supplying steam to a drum, and a hot air supplying step (SS7) for supplying hot air to the drum. It is preferable that the method includes a drum heating step (SS3) for heating the drum before the steam supplying step (SS5). Moreover, the method also includes a water supplying step (SS1) for supplying water to the steam generator for generating the steam required in the steam supplying step (SS5).

It is preferable that the water supplying step (SS1) is performed before the drum heating step (SS3), and it is preferable that a cooling step (SS9) is further included for cooling the drum after the hot air supplying step (SS7). It is preferable that the present invention further includes a water draining step for discharging water remained in the steam generator, i.e., remained water, to an outside of the steam generator after finish of the steam supplying step (SS5). (Detailed water draining step will be described later.) Though the drum heating may be performed with a separate heater mounted to an inside of the drum, use of the hot air heater is simple.

Respective control steps will be described in detail.

In the drum heating step SS3, the drum is heated to a predetermined temperature for making a wrinkle removal effect to be performed in the next steam supply step SS5 more effective. The drum heating step SS3 is performed for a predetermined period T_pre-T_pump. In this instance, it is preferable that the drum is rotated, preferably, tumbled, and more preferably, tumbled, intermittently. The tumbling is rotation of the drum around a speed below 50 rpm, so that the clothes do not stick to an inside wall of the drum, detailed description of which will be omitted because the tumbling is apparent in the field of the art. It is preferable that the drum heating step SS3 is started after the water is supplied to the steam generator for a predetermined time period T_pump to a high water level of the steam generator. It is preferable that the steam heater is put into operation at a time point when the drum heating step SS3 is started, because the steam is generated after lapse of a predetermined time period even if the steam heater starts operation. Moreover, it is preferable that finish of the drum heating step SS3 is substantially coincident with the time point the steam is generated. Because the drum can be kept heated after the steam is generated, i.e., an actual steam supply step SS5, the inside of the drum will be in an excessively high temperature environment enough to gasify the steam supplied thereto, such that there is no steam in the drum.

The steam supply step SS5 is a step for supplying the steam to the drum to perform the wrinkle removing function. The steam supply step SS5 is performed for a predetermined time period T_steam. In this instance, it is preferable that the drum is rotated, preferably, tumbled, and more preferably, tumbled, intermittently. It is preferable that a time period T_steam of the steam supply step SS5 is set in advance by experiments or the like based on factors, such as an amount of the clothes. Since the water level of the steam generator is reduced in the steam supply step SS5, it is preferable that water is supplied if a low water level is sensed In this instance, even though the water may be supplied up to a high water level, it is preferable that the water is supplied for a predetermined time period before the water level reaches to the high water level, for an example, for about three seconds for effective heating. If the water is supplied to the high water level, the supply of steam stops for a predetermined time period due to heating a large amount of water to a boiling temperature. However, if the water is supplied for the predetermined time period, for an example, three seconds, enabling to generate the steam after about one second, the steam can be supplied to the drum, almost continuously.

It is preferable that the tumbling in the steam supply step SS5 is made intermittently, and intermittently repeated, for an example, repeated for three seconds in every one minute. Even though the tumbling of the drum can be kept in the steam supply step SS5, in this case the steam supplied to the drum can be discharged to an outside of the drum without staying in the drum. Because in general the blower unit and the drum are driven with one motor, if the drum is rotated, the blower also is driven, to discharge the steam from the drum to an outside of the drum. Accordingly, in the steam supply step SS5, it is preferable that the drum is rotated intermittently, preferably a rotation time period of the drum is shorter than a pause time period of the drum. Moreover, according to study of the inventor, even though a location of the clothes in the drum is changed during the rotation of the drum, if the drum is stopped, the clothes is located at a lower portion of a front side of the drum substantially, i.e., in the vicinity of the door. Since change of a spray direction of the nozzle is not easy, the nozzle is fixed directed to the lower portion of the front side of the drum. Accordingly, it is preferable that the clothes are placed in the spray direction of the nozzle, i.e., at the lower portion of the front of the drum. Accordingly, in view of absorbing the steam in the clothes, it is preferable that the rotation of the drum is made for a short time period in the steam supply step SS5, so that the clothes is placed in the nozzle spray direction for a longer time period.

In the hot air supply step SS7, the hot air generated by the hot air heater is supplied to the drum, for drying the slightly wet clothes with the steam again. The hot air supply step SS7 is performed for a predetermined time period T_dry, preferably without tumbling the drum. It is preferable that the time period T_dry of the hot air supply step SS7 is set in advance determined by experiments based on factors, such as an amount of the clothes. It is preferable that, after the steam supply step SS5, the remained water in the steam generator is discharged to the cartridge, again. In this instance, it is preferable that, because the remained water in the steam generator has a high temperature, the remained water is not discharged directly, but delayed for a predetermined time period T_delay, and discharged when the temperature of the steam generator is below a predetermined temperature Temp_crit. (details will be described, later)

In the cooling step SS9, the clothes having a temperature thereof elevated in the hot air supply step SS7 is cooled down again. The cooling step SS9 is performed for a predetermined time period T_cooling, preferably without tumbling the drum. It is preferable that the time period T_cooing of the cooling step SS9 is set in advance determined by experiments based on factors, such as an amount of the clothes. Even though cold air can be supplied to the clothes in the cooling step SS9, since a temperature of the clothes is not high relatively, leaving the clothes as it is for a predetermined time period is a simple method and preferable.

A method for controlling the pump will be described with reference to FIGS. 26 and 27.

The method for controlling the pump of the present invention includes a water supply step S100, and S200 for supplying water to the steam generator, and a water drain step S300 for draining the remained water in the steam generator. Of course, it is preferable that the water supply step S100, S200 includes an initial water supply step S100 and a water level maintaining step S200 for maintaining a water level of the steam generator. In the meantime, it is preferable that the water drain step S300 is performed by the pump, and more preferably the water is drained to the detachable water supply source connected to the steam generator.

Respective steps will be described in detail.

As described before, preferably, the water supply step S100, S200 includes the initial water supply step S100, and the water level maintaining step S200 for maintaining a water level of the steam generator. The pump rotates in a regular (forward) direction for supplying the water to the steam generator (S1). It is preferable that, if the water level of the steam generator becomes a high level (S3), the pump stops and the steam heater is put into operation (S5).

If the water is heated to generate the steam as the steam heater is operated, and the generated steam is discharged, the water level of the steam generator is reduced. If the water level of the steam generator becomes the low water level, the pump is rotated in the forward direction, to supply the water to the steam generator. (S9 and S11). In this instance, as described before, though the water may be supplied until the high water level is sensed, in view of heating efficiency, it is preferable that the water is supplied for a predetermined time period, for an example, three seconds.

In the meantime, if a predetermined steam supply time period T_steam is passed (S7), the steam heater is stopped (S13) and a predetermined time period T_delay is delayed (S15). The predetermined time period T_delay is delayed for lowering the temperature of the remained water in the steam generator. Then, if the temperature of the steam generator is lower than a safe temperature Temp_crit (S17), the pump is rotated in a reverse (backward) direction, for a predetermined time period, for an example, about 30 seconds, to recover the remained water in the steam generator (S25). However, if the temperature of the steam generator is higher than the safe temperature Temp_crit, the remained water is not drained from the steam generator directly, but a safety precaution is taken. For an example, it is determined whether the water level of the steam generator is lower than the high water level (S19). If the water level of the steam generator is lower than the high water level, the pump is rotated in the regular direction for a predetermined time period, for an example, about 5 seconds, to supply the water to the steam generator, again (S21). If the water level of the steam generator is not lower than the high water level, the temperature of the steam generator is compared to the safe temperature (S23). If the temperature of the steam generator is lower than the safe temperature Temp_crit (S23), the pump is rotated in the reverse direction for a predetermined time period, for an example, about 30 seconds, the remained water is drained from the steam generator (S25). However, if the temperature of the steam generator is higher than the safe temperature Temp_crit, the pump is not rotated in the reverse direction, but stopped (S27). Of course, the temperature may be compared after a predetermined time period, to drain the remained water if requirement is satisfied The safe temperature Temp_crit could be the highest temperature at which reliability of the pump can be maintained, for an example, approx. 60 degrees.

Figure 26:
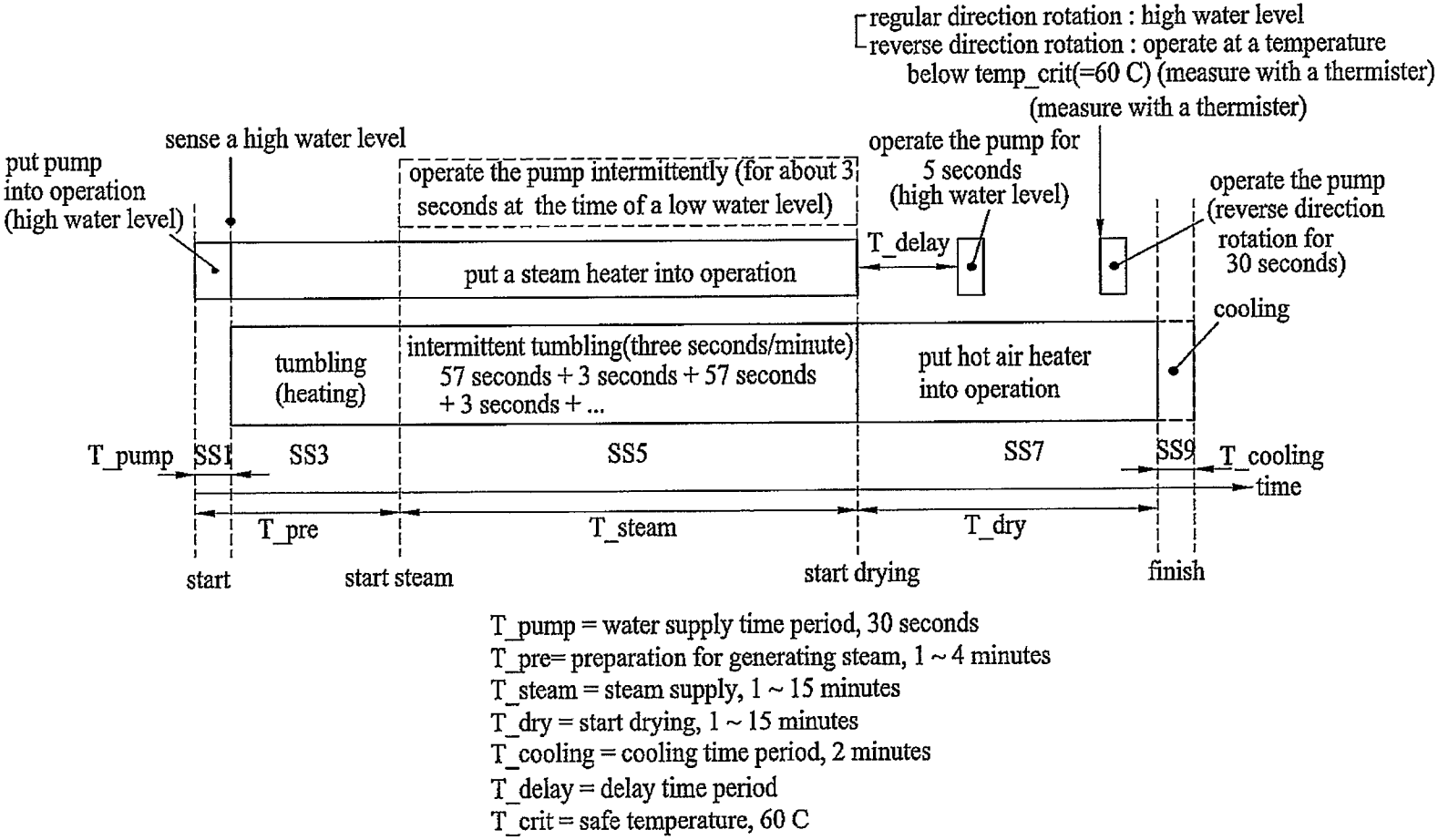
FIG. 26 is a diagram illustrating an embodiment of a method for controlling a dryer in accordance with a preferred embodiment of the present invention.
Figure 27:
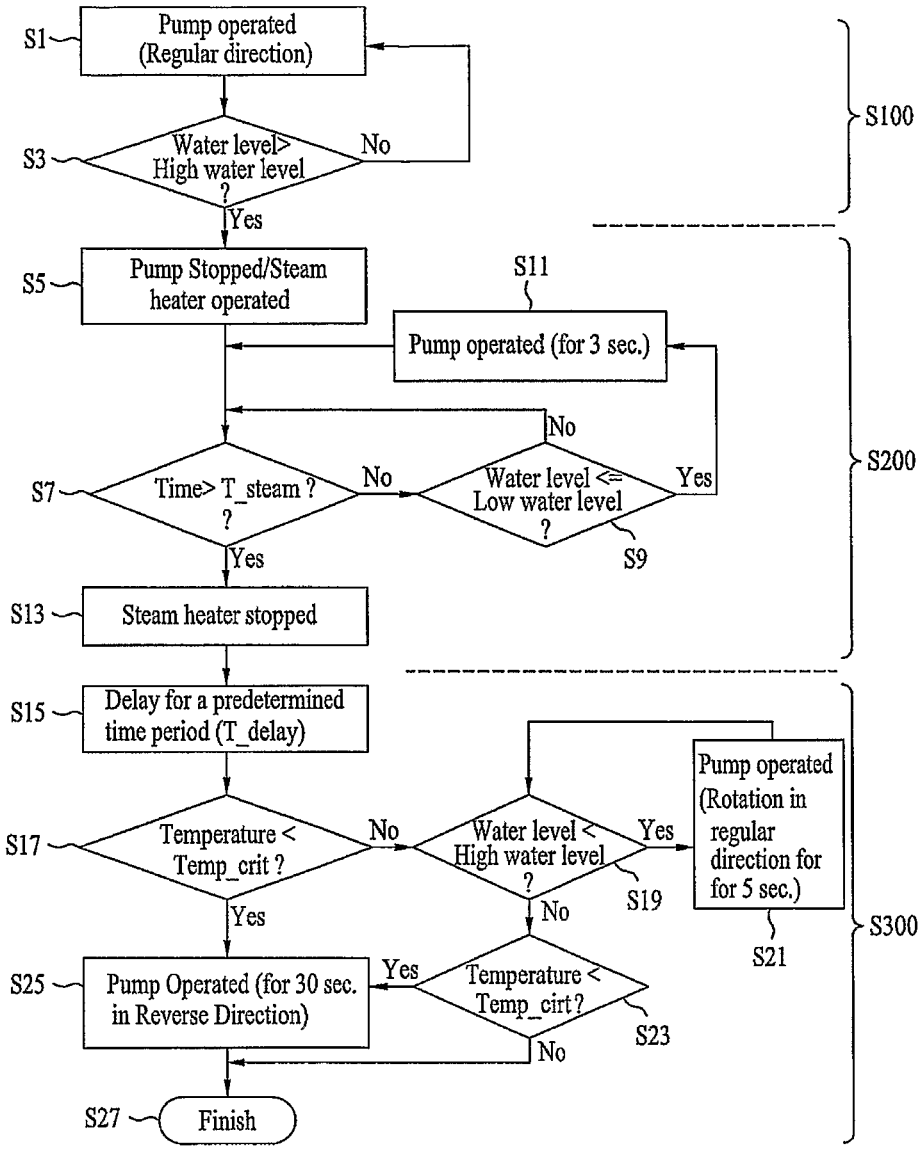
FIG. 27 illustrates a flow chart showing the steps of a method for controlling a pump in FIG. 26.

FIGS. 26 and 27 shows the water supply time period T_pump, the steam generating preparation time period T_pre, the steam supply time period T_steam, the drying time period T_dry, the cooling time period T_cooling, the delay time period T_delay, the tumbling time period, the pump operation time period, and so on which are examples. These factors such as time can be changed appropriately according to a capacity of the dryer, an amount of the clothes, and the like.

Figure 28:
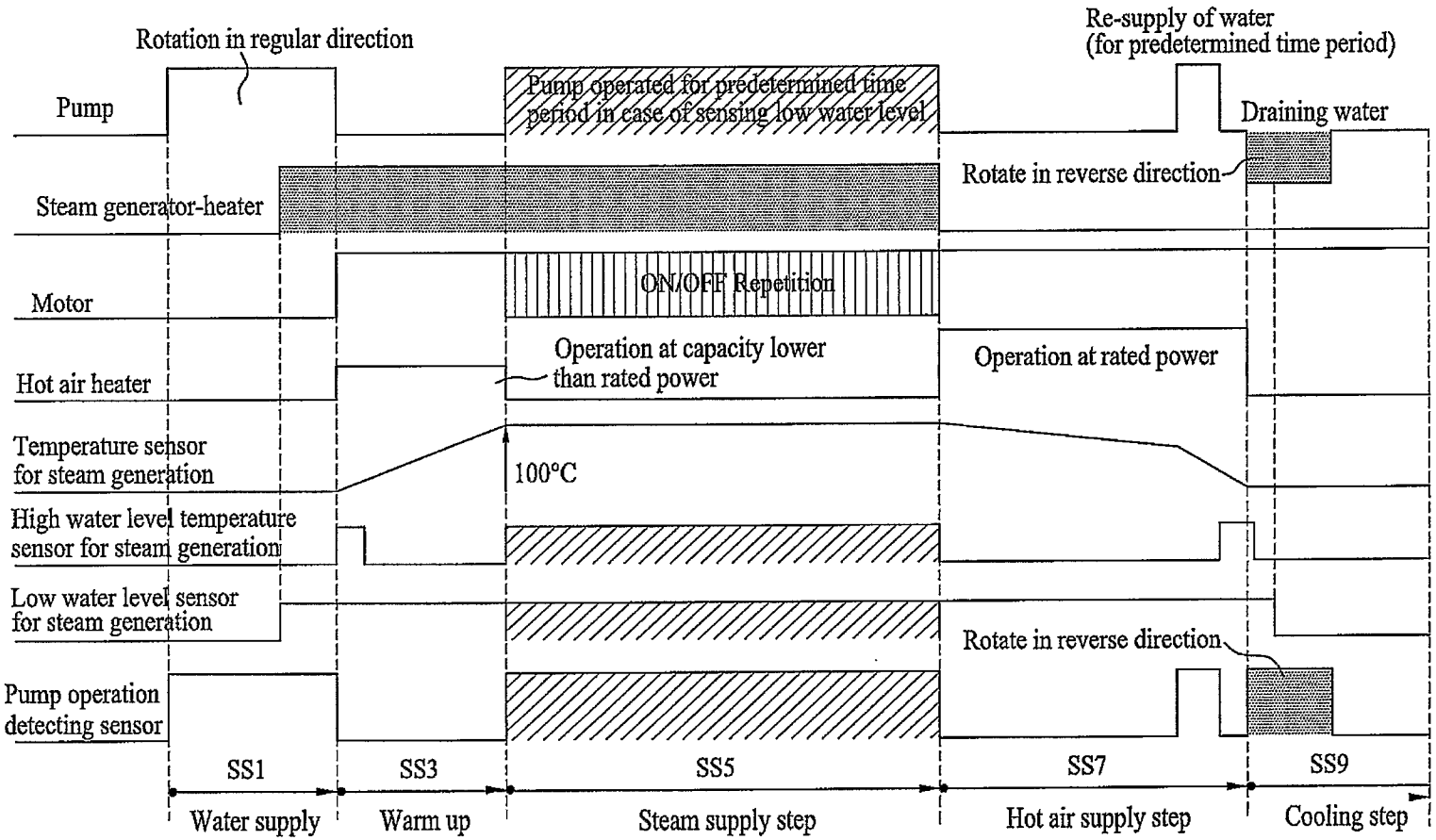
FIG. 28 is a diagram illustrating another embodiment of the method for controlling the dryer in accordance with the present invention.

With reference to FIG. 28, another embodiment of a method for controlling the dryer according to the present invention will be described.

This embodiment has the same principle of the above embodiment, except that steam generation is more efficient.

In the steam supply step (SS5), steam is substantially supplied to the drum. At this time, when the steam generator is operated, it takes a predetermined time to boil water and thus the steam is not generated at the moment when the steam generator starts to operate. As a result, it is preferable that the steam generator is operated a predetermined time before the steam is substantially supplied to the drum. Here, if a water level inside the steam generator is low, the heater of the steam generator starts to operate.

On the other hand, the starting time of the drum heating (SS3), that is, the starting time of the operation of the hot air heater, may be after the steam generator starts to operate. However, considering the heat capacity of water inside the steam generator, it is preferable that the hot air heater is operated when a water level of the steam generator is high.

That is, it is preferable that only the heater of the steam generator is operated when the water level of the steam generator is between the low water level and the high water level. At this time, while the hot air heater may be operated at the rated power, it is preferable that the hot air heater is operated at a predetermined power smaller than the rated power. For example, if the rated power of the hot air heater is 5400 W, the hot air heater may be operated at 2700 W which is approximately half of the rated power. That is because the heater of the steam generator is put in operation in the drum heating step (SS3). As a result, if the hot air heater is operated at the rated power, the power supplied to the dryer in total should be increased.

If the water level of the steam generator is high, the water supply step (SS1) for supplying water to the steam generator is completed. However, preferably, the water supply step is forcibly finished and the following step forcibly starts in a predetermined time period after the pump is operated, for example, in 90 minutes, regardless of sensing the high water level of the steam generator. If the high water level of the steam generator is not sensed because of steam generator malfunction or the like, the water of the steam generator might overflows to the drum. Thus, it is preferable that the following step may start in a predetermined time period.

The drum heating step (SS3) is also finished when steam starts to be generated at the steam generator. However, preferably, the drum heating step (SS3) is forcibly finished and the following step starts in a predetermined time period, for example, in 5 minutes. Although the possibility of hot air heater malfunction is commonly low, it is better as a matter of safety to start the following step after the predetermined time passes.

According to an experiment result by the inventor, though there are differences depending on kinds of fabric, and extents of water absorption, the refresh operation of the present invention has a wrinkle removal and prevention effect. As an example of the clothes washed and dehydrated in a washing machine is explained, the clothes are not limited to these. For an example, small wrinkles on clothes already in a dried state such as clothes wore for about during a day can be removed in the dryer of the present invention, which can be especially useful. That is, as a kind of wrinkle removal appliance, the dryer of the present invention may be used.

Figure 29:
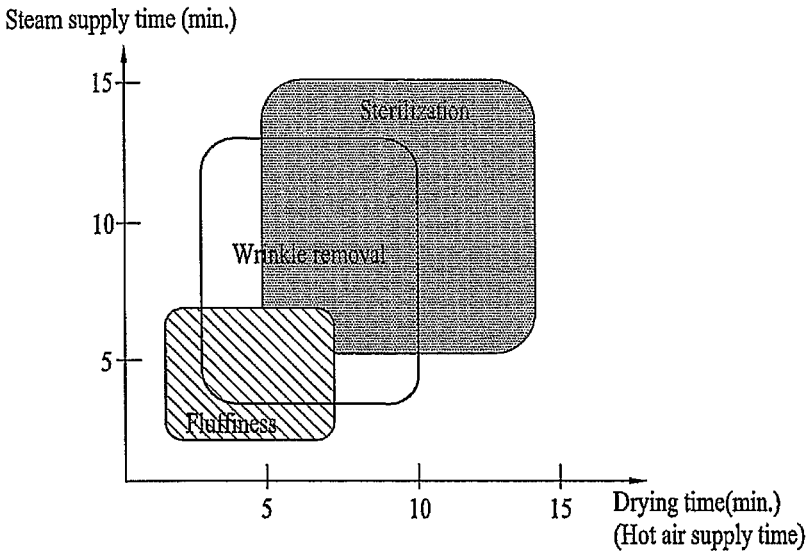
FIG. 29 is a diagram illustrating a further embodiment of the method for controlling the dryer in accordance with the present invention.

With reference to FIG. 29, a further embodiment of a method for controlling the dryer according to the present invention will be described.

As mentioned above, there is an effect of removing wrinkles according to the refresh operation. Moreover, according to experiments performed by the present inventor, there is an effect of laundry sterilization and laundry fluffiness because of the refresh operation. Basically, an operation of the dryer for such function may include a steam supply step and a hot air supply step (drying step). However, it is preferable that a steam supply time and a hot air supply time are adjustable based on their objects. For example, in case of laundry sterilization, it is better for the operation of laundry sterilization to take more time to supply steam and hot air, compared to the operation of wrinkle removal. It is also better for the operation of laundry fluffiness to take less time to supply steam and hot air, compared to the operation of wrinkle removal. The optimal time may be determined adjustably by experiments, considering the laundry amount or the like.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The dryer and the method for controlling the same of the present invention have the following advantages.

First, wrinkles or rumples of clothes in the dryer can be prevented or removed. Moreover, clothes can be sterilized, or deodored.

Second, wrinkles or rumples can be removed from clothes of a dried state without separate ironing, effectively.

The invention claimed is:

1. A method for controlling a dryer, comprising:

pre-heating an inside of a drum, comprising initiating operation of a heater of a steam generator, and thereafter initiating operation of a hot air heater in a pre-heating mode, and supplying hot air generated by the hot air heater to the drum for a predetermined drum heating period as the heater of the steam generator heats water received in the steam generator;

supplying steam generated by the steam generator into the drum when the water received in the steam generator reaches a predetermined steam temperature; and operating the hot air heater in a drying mode and supplying hot air generated by the hot air heater into the drum, wherein the heater of the steam generator is operated while the hot air heater is operated in the pre-heating mode to pre-heat the inside of the drum, and wherein initiating operation of the hot air heater in the pre-heating mode comprises operating the hot air heater at a predetermined power level that is lower than a rated power level of the hot air heater.

2. The method as claimed in claim 1, wherein initiating operation of the hot air heater in the pre-heating mode comprises operating the hot air heater when a water level inside the steam generator is high.

3. The method as claimed in claim 1, further comprising stopping operation of the hot air heater when the predetermined drum heating period has elapsed and steam generated by the steam generator is supplied to the drum.

4. The method as claimed in claim 1, wherein heating the inside of the drum further comprises forcibly stopping operation of the hot air heater after a predetermined amount of operation time has elapsed.

5. The method as claimed in claim 1, wherein heating the inside of the drum further comprises rotating the drum.

6. The method as claimed in claim 1, further comprising rotating the drum while steam is supplied into the drum.

7. The method as claimed in claim 6, wherein rotating the drum comprises rotating the drum intermittently.

8. The method as claimed in claim 7, wherein rotating the drum comprises rotating the drum such that a rotation time of the drum is longer than a stopping time of the drum.

9. The method as claimed in claim 1, wherein initiating operation of the steam generator comprises heating water inside the steam generator when a water level inside the steam generator is low.

10. The method as claimed in claim 9, further comprising stopping a water supply to the steam generator when the water level inside the steam generator is high.

11. The method as claimed in claim 1, wherein supplying steam generated by the steam generator comprises supplying water to the steam generator for a predetermined time period when a water level inside the steam generator is low.

12. The method as claimed in claim 1, further comprising cooling the drum.

13. The method as claimed in claim 12, further comprising:

draining water in the steam generator after finishing the supplying steam.

14. The method as claimed in claim 13, wherein draining water in the steam generator comprises pumping the water inside the steam generator to an outside of the steam generator.

15. The method as claimed in claim 1, wherein supplying steam comprises supplying steam for a steam supply time and supplying hot air in the drying mode comprises supplying hot air for a hot air supply time, wherein in the steam supply time and the hot air supply time are adjustable.

16. The method as claimed in claim 15, wherein the steam supply time and hot air supply time for a laundry sterilization operation are relatively longer than the steam supply time and the hot air supply time for a wrinkle removal operation.

17. The method as claimed in claim 15, wherein the steam supply time and the hot air supply time for a laundry fluffiness operation are relatively shorter than the steam supply time and the hot air supply time for a wrinkle removal operation.

18. The method as claimed in claim 1, wherein supplying steam generated by the steam generator into the drum comprises supplying steam generated by the steam generator into the drum while the hot air heater supplies hot air to the drum such that steam and hot air are supplied to the drum simultaneously for a predetermined portion of the predetermined drum heating period.

19. A method for controlling a dryer, comprising:

pre-heating an inside of a drum, comprising:

initiating operation of a heater of a steam generator and then initiating operation of a hot air heater in a pre-heating mode and simultaneously operating the heater of the steam generator and the hot air heater until the steam generator heats water received in the steam generator to a predetermined steam temperature; and thereafter stopping operation of the hot air heater in the pre-heating mode and continuing operation of the heater of the steam generator and supplying steam generated during the simultaneous operation of the heater of the steam generator and the hot air heater to a drum; and thereafter initiating operation of the hot air heater in a drying mode and supplying hot air generated by the hot air heater to the drum.

* * * * *